US010040650B2

(12) United States Patent
Kuriki

(10) Patent No.: US 10,040,650 B2
(45) Date of Patent: Aug. 7, 2018

(54) SHEET FEEDER PROVIDED WITH FEED ROLLER AND REVERSE ROLLER

(71) Applicant: Brother Kogyo Kabushiki Kaisha, Nagoya-shi, Aichi-ken (JP)

(72) Inventor: Yuichiro Kuriki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/049,237

(22) Filed: Feb. 22, 2016

(65) Prior Publication Data

US 2016/0250871 A1 Sep. 1, 2016

(30) Foreign Application Priority Data

Feb. 27, 2015 (JP) ..... 2015-037840

(51) Int. Cl.
*B41J 2/00* (2006.01)
*B65H 3/34* (2006.01)
*B65H 3/52* (2006.01)

(52) U.S. Cl.
CPC ..... *B65H 3/34* (2013.01); *B65H 3/5284* (2013.01); *B65H 2404/725* (2013.01); *B65H 2801/39* (2013.01)

(58) Field of Classification Search
None
See application file for complete search history.

(56) References Cited

U.S. PATENT DOCUMENTS 5,887,866 A 3/1999 Yamauchi et al.
2011/0006469 A1* 1/2011 Matsushima ..... B65H 1/266 271/4.1
2014/0042689 A1* 2/2014 Ota ..... B65H 3/06 271/10.11
2014/0061998 A1* 3/2014 Kasashima ..... B65H 5/06 271/10.11

FOREIGN PATENT DOCUMENTS

JP H09-086702 A 3/1997

* cited by examiner

*Primary Examiner* — Matthew Luu
*Assistant Examiner* — Tracey McMillion
(74) *Attorney, Agent, or Firm* — Banner & Witcoff, Ltd.

(57) ABSTRACT

A sheet feeder includes: a feed roller; a transmission mechanism for transmitting a first drive force to the feed roller to rotate the feed roller in a feeding direction; a motor rotatable in a forward direction and in a reverse direction opposite the forward direction to generate a second drive force; a reverse roller rotatable in the feeding direction and in a counter-feeding direction opposite the feeding direction by the second drive force; and a driven part driven by the second drive force. The transmission mechanism transmits the first drive force to the feed roller to rotate the feed roller in the feeding direction in case that the reverse roller is rotated in the feeding direction; and the transmission mechanism transmits the first drive force to the feed roller to rotate the feed roller in the feeding direction in case that the reverse roller is rotated in the counter-feeding direction.

11 Claims, 11 Drawing Sheets

SHEET FEEDER PROVIDED WITH FEED ROLLER AND REVERSE ROLLER

CROSS REFERENCE TO RELATED APPLICATION

This application claims priority from Japanese Patent Application No. 2015-037840 filed Feb. 27, 2015. The entire content of the priority application is incorporated herein by reference.

TECHNICAL FIELD

The present disclosure relates to a sheet feeder.

BACKGROUND

Conventionally, sheet feeders have had a separating function for separating and feeding a plurality of sheets in order to feed the sheets one at a time in a feeding direction. For example, one of such conventional sheet feeders includes a feed roller and a retard roller arranged in confrontation with each other. To activate the separating function of the sheet feeder, the retard roller is rotated in a direction opposite the feeding direction, while the feed roller is rotated in the feeding direction.

SUMMARY

According to an aspect of the disclosure, there is provided a sheet feeder including a feed roller, a transmission mechanism, a motor, a reverse roller and a driven part. The feed roller is configured to rotate in a feeding direction. The transmission mechanism is configured to transmit a first drive force to the feed roller to rotate the feed roller in the feeding direction, the transmission mechanism including a rotational shaft of the feed roller. The motor includes a drive shaft configured to rotate in a forward direction and in a reverse direction opposite the forward direction to generate a second drive force. The reverse roller is configured to contact the feed roller and rotate in the feeding direction and in a counter-feeding direction opposite the feeding direction upon receipt of the second drive force from the motor, the reverse roller being configured to rotate in the counter-feeding direction in response to rotation of the drive shaft in the reverse direction, the reverse roller being configured to rotate in the feeding direction in response to rotation of the drive shaft in the forward direction. The driven part is configured to be driven upon receipt of the second drive force from the motor in response to the rotation of the drive shaft in the forward direction. The transmission mechanism is configured to transmit the first drive force to the feed roller to cause the feed roller to perform a first operation for rotating the feed roller in the feeding direction in case that the reverse roller is rotated in the feeding direction and the driven part is driven in response to the rotation of the drive shaft in the forward direction. After the feed roller performed the first operation, the transmission mechanism is configured to transmit the first drive force to the feed roller to cause the feed roller to perform a second operation for rotating the feed roller in the feeding direction in case that the reverse roller is rotated in the counter-feeding direction in response to the rotation of the drive shaft in the reverse direction.

According to another aspect of the disclosure, there is provided a sheet feeder including a feed roller, a first motor, a transmission mechanism, a second motor, a reverse roller, a driven part and a controller. The feed roller is configured to rotate in a feeding direction. The first motor is configured to generate a first drive force. The transmission mechanism is configured to transmit the first drive force from the first motor to the feed roller to rotate the feed roller in the feeding direction, the transmission mechanism including a rotational shaft of the feed roller. The second motor includes a drive shaft configured to rotate in a forward direction and in a reverse direction opposite the forward direction to generate a second drive force. The reverse roller is configured to contact the feed roller and rotate in the feeding direction and in a counter-feeding direction opposite the feeding direction upon receipt of the second drive force from the second motor, the reverse roller being configured to rotate in the counter-feeding direction in response to rotation of the drive shaft in the reverse direction, the reverse roller being configured to rotate in the feeding direction in response to rotation of the drive shaft in the forward direction. The driven part is configured to be driven upon receipt of the second drive force from the second motor in response to the rotation of the drive shaft in the forward direction. The controller is configured to perform: a first control to the second motor to rotate the drive shaft in the forward direction to rotate the reverse roller in the feeding direction and to drive the driven part; a first control to the first motor, during the first control to the second motor, to generate the first drive force to rotate the feed roller in the feeding direction; a second control to the second motor, after the first control to the second motor is ended, to rotate the drive shaft in the reverse direction to rotate the reverse roller in the counter-feeding direction; and a second control to the first motor, during the second control to the second motor, to generate the first drive force to rotate the feed roller in the feeding direction.

According to still another aspect of the disclosure, there is provided a sheet feeder including a feed roller, a transmission mechanism, a motor, a reverse roller, and a shutter. The feed roller is configured to rotate in a feeding direction. The transmission mechanism is configured to transmit a first drive force to the feed roller to rotate the feed roller in the feeding direction, the transmission mechanism including a rotational shaft of the feed roller. The motor includes a drive shaft configured to rotate in a forward direction and in a reverse direction opposite the forward direction, the motor being configured to rotate the drive shaft to generate a second drive force. The reverse roller is configured to contact the feed roller, the reverse roller and the feed roller defining a sheet conveying path therebetween along which a sheet is configured to be conveyed, the reverse roller being configured to rotate in the feeding direction and in a counter-feeding direction opposite the feeding direction upon receipt of the second drive force from the motor, the reverse roller being configured to rotate in the counter-feeding direction in response to rotation of the drive shaft in the reverse direction, the reverse roller being configured to rotate in the feeding direction in response to rotation of the drive shaft in the forward direction. The shutter is configured to move between a first position and a second position upon receipt of the second drive force from the motor, the shutter being moved to the first position in response to the rotation of the drive shaft in the forward direction and the shutter being moved to the second position in response to the rotation of the drive shaft in the reverse direction, the shutter at the first position having a portion crossing the sheet conveying path and the shutter at the second position being retracted from the sheet conveying path. The transmission mechanism is configured to transmit the first drive force to the feed roller to cause the feed roller to perform a first operation for rotating the feed roller in the feeding direction, and the transmission mechanism is configured to transmit the first drive force to the feed roller to cause the feed roller to perform a second operation for rotating the feed roller in the feeding direction after the first operation is ended. The drive shaft is configured to rotate first in the forward direction and subsequently in the reverse direction, the reverse roller being rotated in the feeding direction and the driven part being driven in response to the rotation of the drive shaft in the forward direction, the reverse roller being rotated in the counter-feeding direction in response to the rotation of the drive shaft in the reverse direction, the first operation being performed for a certain period of time within a time span starting from a timing at which the drive shaft starts rotating in the forward direction and ending at a timing at which the drive shaft starts rotating in the reverse direction, the second operation being performed no earlier than the drive shaft starts rotating in the reverse direction.

BRIEF DESCRIPTION OF THE DRAWINGS

The particular features and advantages of the disclosure as well as other objects will become apparent from the following description taken in connection with the accompanying drawings, in which.

DETAILED DESCRIPTION

In a sheet feeder provided with the separating function, it is conceivable to provide the sheet feeder with a shutter or other driven member for regulating sheets that advance to a position between the feed roller and retard roller and to drive both the driven member and the retard roller with a single motor, for example. In this configuration, the retard roller and feed roller contact and press against each other. In this case, the sheet feeder can be constructed such that the retard roller is configured to rotate in the direction opposite the sheet feeding direction when a drive shaft of the motor is rotated in a reverse direction, while the driven member is driven when the drive shaft of the motor is rotated in a forward direction.

It is an object of an embodiment of the disclosure to provide an improved sheet feeder having a motor for driving both a driven member and a retard roller to reduce a potential for sheet conveyance problems.

Hereinafter, an image-reading device 1 according to the embodiment of the present disclosure will be described while referring to FIGS. 1 through 10.

1. Overall Structure of the Image-Reading Device 1

Figure 1:
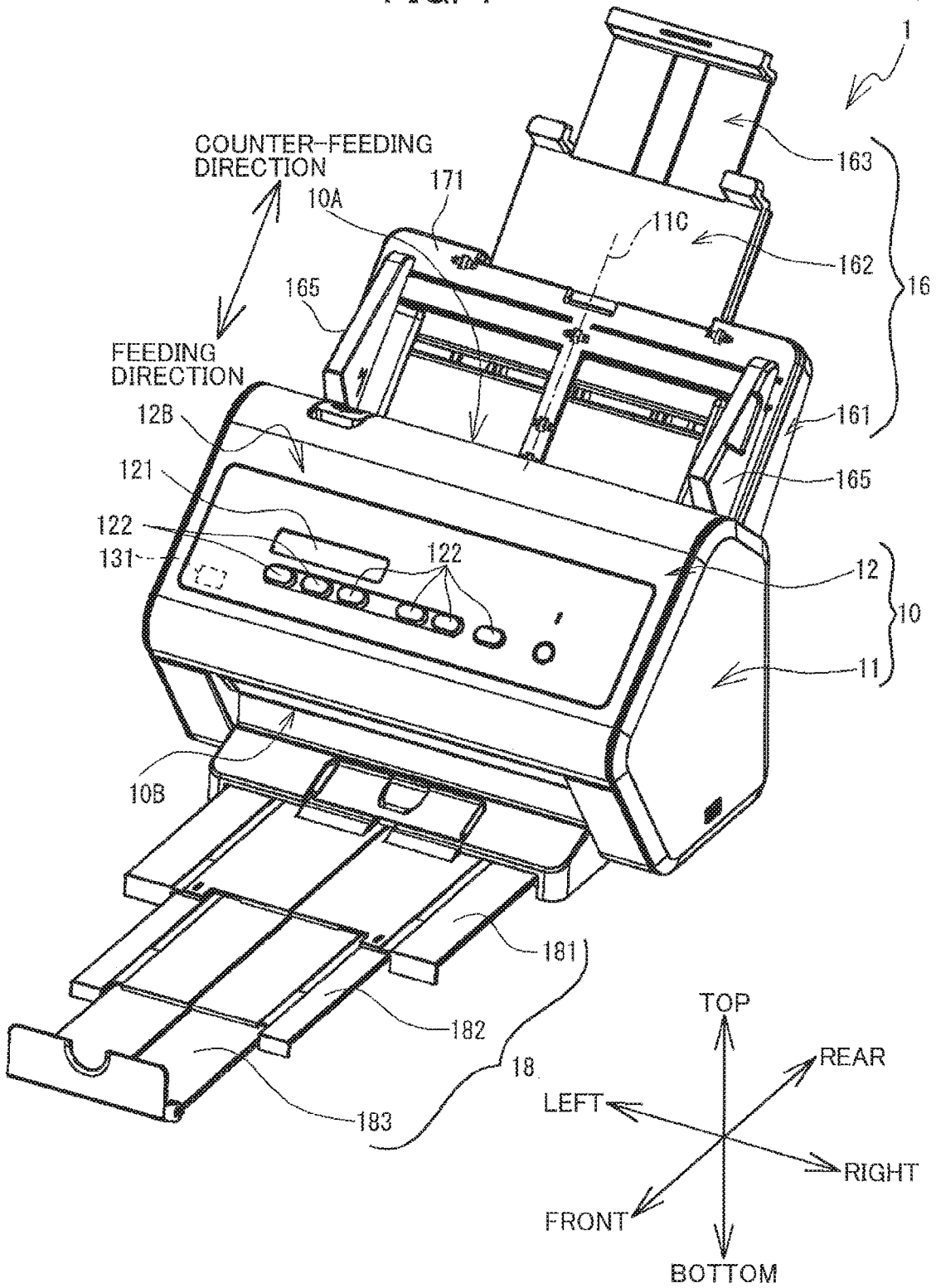
FIG. 1 is a perspective view showing an external construction of an image-reading device 1 according to an embodiment.
Figure 2:
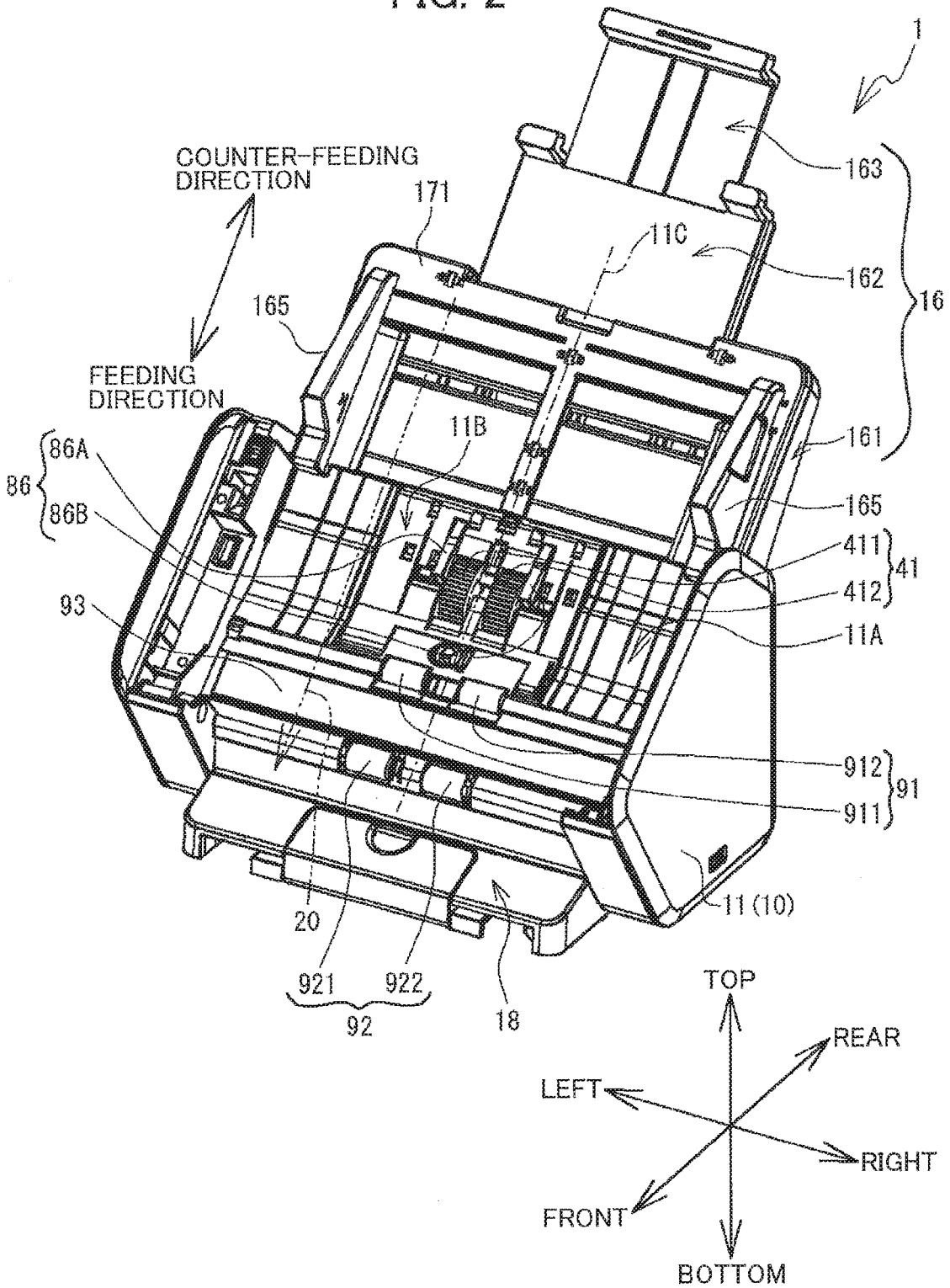
FIG. 2 is a perspective view showing a structure of the image-reading device 1 according to the embodiment, wherein a second casing 11 is removed.

As shown in FIGS. 1 and 2, the image-reading device 1 includes a casing 10, a sheet-feed tray 16, and a discharge tray 18.

In the following description, the top, bottom, upper-left, lower-right, lower-left, and upper-right sides in FIG. 1 will be referred to respectively as the top, bottom, left, right, front, and rear sides of the image-reading device 1.

As shown in FIG. 1, the casing 10 includes a first casing 11, and a second casing 12. Both the first casing 11 and second casing 12 have a box-like shape. In FIG. 2, the second casing 12 is excluded from the casing 10 and is not shown.

As shown in FIG. 2, the first casing 11 has a top surface 11A. The top surface 11A slopes downward from the rear side toward the front side. The first casing 11 pivotably supports a bottom edge of the second casing 12 at both left and right sides on the bottom edge of the top surface 11A. In other words, the second casing 12 can pivotally move, along its bottom edge, between a closed position shown in FIG. 1 and an open position (not shown) about a virtual line (not shown) extending in the left-right direction.

The first casing 11 mainly includes a support member 11B, a set guide 86, a feed roller 41, a conveying roller 91, a conveying roller 92 and an image reader 93. The support member 11B constitutes a left-right center and rearward portion of the top surface 11A. The support member 11B is disposed around the feed roller 41 and set guides 86. The set guide 86 will be described later.

In the following description, a virtual line extending along the top surface 11A and passing through the left-right center of the same will be called a centerline 11C. Unless otherwise specified, clockwise and counterclockwise directions will indicate rotational directions from a right-side perspective.

As shown in FIG. 2, the feed roller 41 is configured of two feed rollers 411 and 412. The conveying roller 91 is configured of two conveying rollers 911 and 912. The conveying roller 92 is configured of two conveying rollers 921 and 922. In the following description, the feed rollers 411 and 412 may be collectively referred to as the feed roller 41; the conveying rollers 911 and 912 may be collectively referred to as the conveying roller 91, and the conveying rollers 921 and 922 may be collectively referred to as the conveying roller 92. The feed roller 41, conveying roller 91, and conveying roller 92 are arranged along the top surface 11A in order from the upper-rear side to the lower-front side. The feed roller 411, conveying roller 911, and conveying roller 921 are arranged on the left side of the centerline 11C, while the feed roller 412, 912, and conveying roller 922 are arranged on the right side of the centerline 11C.

The image reader 93 is a contact image sensor well known in the art. The image reader 93 is provided on the top surface 11A of the first casing 11 between the conveying roller 91 and conveying roller 92. The image reader 93 is electrically connected to a controller 131 provided on the second casing 12 (see FIG. 3). The image reader 93 is configured to read an image from a sheet as the sheet is conveyed in a feeding direction (i.e., from the upper-rear side toward the lower-front side along the top surface 11A, as shown in FIGS. 1 and 2). The image reader 93 is configured to output data indicating the read image to the controller 131.

Figure 3:
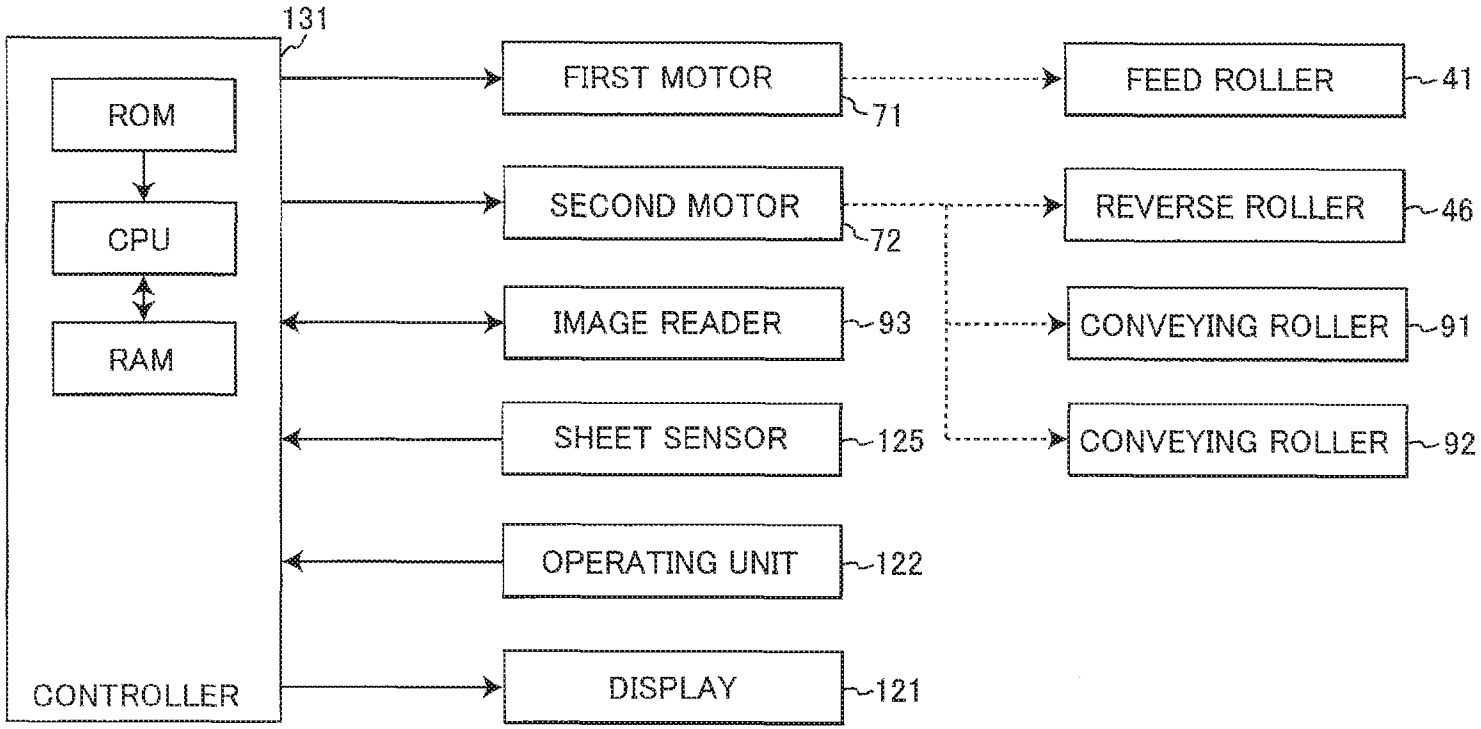
FIG. 3 is a diagram conceptually illustrating functional blocks of the image-reading device 1 according to the embodiment.

As shown in FIG. 1, the second casing 12 has a top surface 12B constituting an upper surface of the casing 10. A display 121 and operating unit 122 are provided on the top surface 12B. The operating unit 122 includes a plurality of push buttons enabling a user to input instructions into the image-reading device 1. The display 121 and operating unit 122 are electrically connected to the controller 131, as shown in FIG. 3. The controller 131 is provided on an underside of the second casing 12, i.e., the side opposite the top surface 12B, for example. The controller 131 includes a storage (a CPU, for example) configured to control operations of the image-reading device 1, a ROM for storing programs by which the CPU controls operations of the image-reading device 1, and a RAM for temporarily storing data (see FIG. 3).

Figure 5:
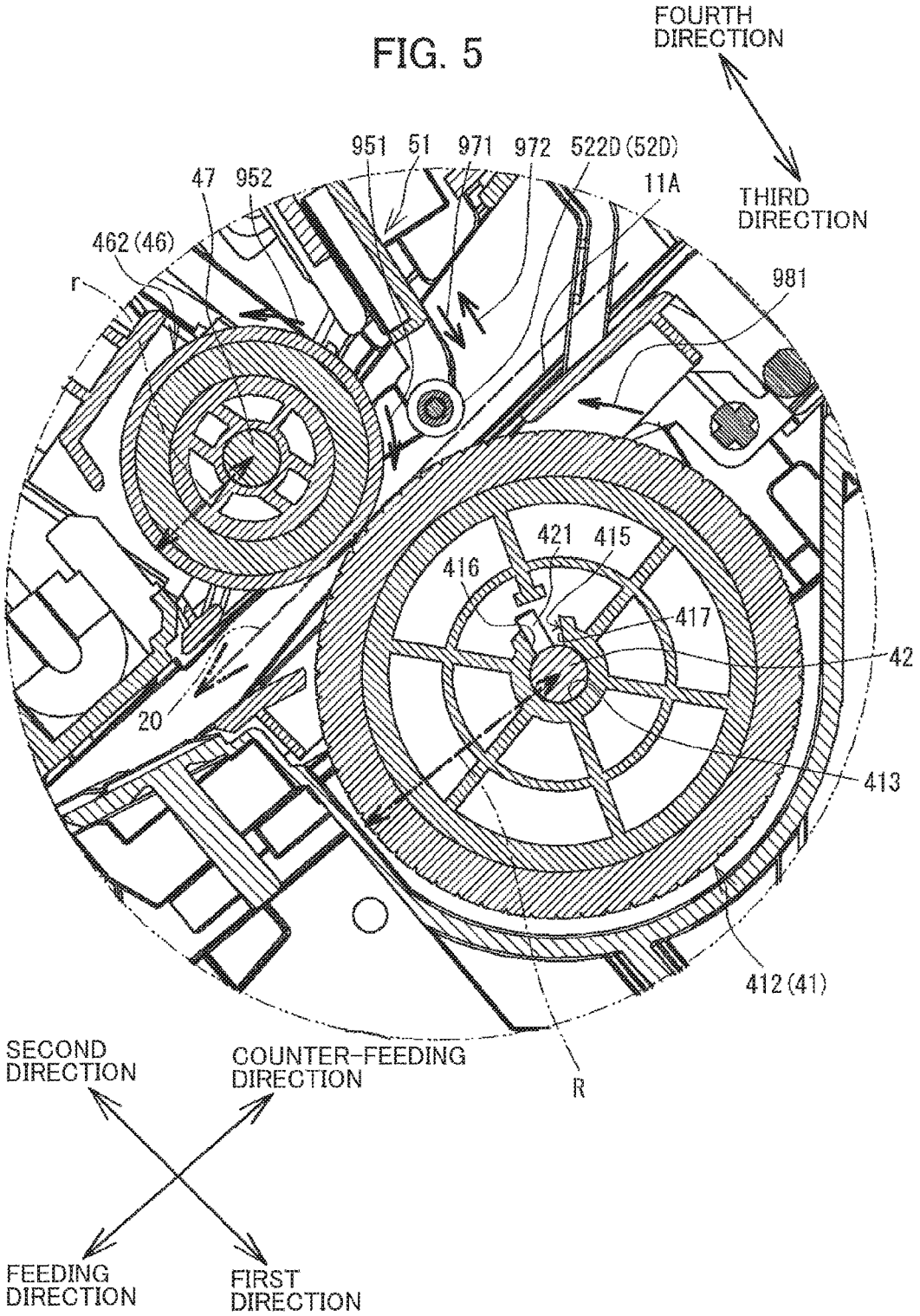
FIG. 5 is a partially-enlarged cross-sectional view showing an essential portion of the image-reading device 1 according to the embodiment, and showing a state of the feeding roller 41 and a shaft member 42 when a first operation is performed according to the embodiment.

A feed opening 10A is formed in the area between the top edge of the second casing 12 and the top surface 11A, as shown in FIG. 1. A discharge opening 10B is formed in the area between the bottom edge of the second casing 12 and the top surface 11A. Further, a lower surface of the second casing 12 and top surface 11A of the first casing 11 define a conveying path 20 therebetween, as shown in FIGS. 2 and 5. The conveying path 20 communicates with the exterior of the casing 10 through the feed opening 10A and the discharge opening 10B.

As shown in FIGS. 1 and 2, the sheet-feed tray 16 is provided rearward of the casing 10. The sheet-feed tray 16 includes sheet-feeding sections 161, 162, and 163. The sheet-feeding sections 161-163 all have a plate-like shape. The sheet-feeding section 161 extends diagonally upward and rearward from a rear end portion of the first casing 11 to the rear of the feed opening 10A. The sheet-feeding section 161 has an upper surface serving as a tray surface 171. Guides 165 are provided one each on the left and right halves of the tray surface 171. The guides 165 can move in the left-right direction over the tray surface 171. The guides 165 function to center the position of sheets placed on the sheet-feeding section 161 with respect to the left-right direction. The sheet-feeding section 162 extends diagonally upward and rearward from a top edge of the sheet-feeding section 161. The sheet-feeding section 163 extends diagonally upward and rearward from a top edge of the sheet-feeding section 162. The sheet-feeding sections 162 and 163 can move diagonally upward and rearward and diagonally downward and forward.

As shown in FIG. 1, the discharge tray 18 is provided frontward of the casing 10. The discharge tray 18 includes discharge sections 181, 182, and 183. Each of the discharge sections 181-183 has a plate-like shape. The discharge section 181 extends forward from a front end portion of the first casing 11 below the discharge opening 10B. The discharge section 182 extends forward from a front edge of the discharge section 181. The discharge section 183 extends forward from a front edge of the discharge section 182. The discharge sections 181-183 can move in the front-rear direction.

Hereinafter, a direction from the feed opening 10A toward the discharge opening 10B (from the upper-rear side toward the lower-front side from the upper-rear side along the top surface 11A and the lower surface of the second casing 12) is defined as the feeding direction, whereas a direction opposite the feeding direction (i.e., direction from the discharge opening 10B toward the feed opening 10A; from the lower-front side toward the upper-rear side along the top surface 11A and the lower surface of the second casing 12) is defined as a counter-feeding direction. That is, in the image-reading device 1, sheets placed on the sheet-feed tray 16 are configured to be fed into the casing 10 through the feed opening 10A, conveyed along the conveying path 20 within the casing 10 in the feeding direction, and discharged out of the casing 10 onto the discharge tray 18 through the discharge opening 10B.

2. Detailed Structure of the Casing 10

In addition to the above-described elements such as the feed roller 41 and the conveying rollers 91 and 92, there are also provided a reverse roller 46, a pressing mechanism 50, a cam member 60, a shutter mechanism 80, and a drive mechanism 70 (including a first motor 71 and a second motor 72) in the casing 10.

<Feed roller 41>

Figure 4:
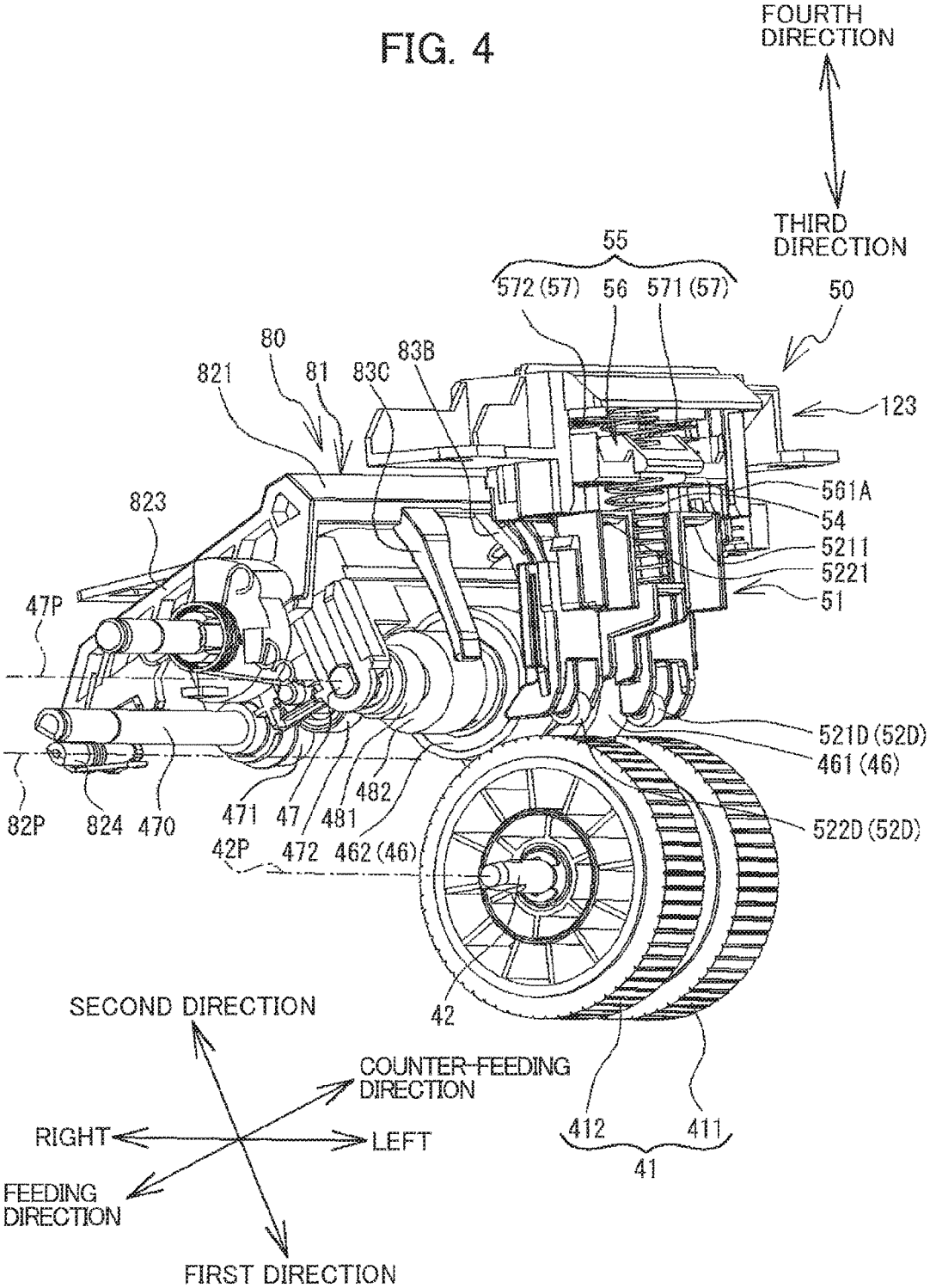
FIG. 4 is a perspective view conceptually explaining positional relationships between feeding roller 41, reverse roller 46 and a pressing mechanism 50 provided in the image-reading device 1 according to the embodiment.

As shown in FIG. 4, the feed roller 41 is provided in the first casing 11. The feed rollers 411 and 412 respectively define axial directions coincident with the left-right direction. The feed rollers 411 and 412 have substantially the same shape as each other (i.e., substantially circular shape in a side view). As shown in FIGS. 4 and 5, a shaft member 42 serving as a rotational shaft of the feed roller 41 is inserted through a center portion of the feed roller 41 in a right side view.

More specifically, as illustrated in FIG. 5, the feed roller 41 has a center portion in a right side view serving as a hole part 413. The hole part 413 defines a through-hole that penetrates the hole part 413 in the left-right direction. An opening part 415 is formed in a circumferential portion of the hole part 413 so as to open radially outward. The opening part 415 is elongated in the left-right direction. Specifically, the opening part 415 is defined by a wall portion 416 on the counterclockwise side (feeding-direction side) and a wall portion 417 on the clockwise side (counter-feeding-direction side) in a circumferential direction of the opening part 415 in a right side view. The opening part 415 is in communication with the through-hole formed in the hole part 413.

The shaft member 42 is longitudinally oriented in the left-right direction and is inserted into the through-hole formed in the hole part 413 of the feed roller 41. The shaft member 42 has a circumferential surface on which a pin 421 is provided to protrude radially outward therefrom. The pin 421 is inserted into the opening part 415 such that the wall portion 416 is positioned on the counterclockwise side of the pin 421. The pin 421 has a smaller length in the circumferential direction thereof than the distance between the wall portions 416 and 417 of the opening part 415. The shaft member 42 is rotatably supported in the first casing 11. The shaft member 42 is configured to rotate counterclockwise in FIG. 5 (i.e., in the feeding direction) in response to rotation of a drive shaft of the first motor 71 described later. When the shaft member 42 rotates counterclockwise, the pin 421 is brought into contact with the wall portion 416 and pushes the wall portion 416 counterclockwise, thereby transmitting a drive force from the first motor 71 to the feed roller 41 to rotate the feed roller 41 in the feeding direction. The shaft member 42 constitutes a part of a transmission mechanism 71A described later.

Specifically, in response to the rotation of the shaft member 42, the feed roller 41 is configured to rotate in the feeding direction about a virtual line 42P (an imaginary line shown in FIG. 4 that extends in the left-right direction and passes through an axis of the shaft member 42). As shown in FIG. 5, a part of the feed roller 41 protrudes above the top surface 11A of the first casing 11.

<Conveying Rollers 91 and 92>

As shown in FIG. 2, the conveying rollers 91 and 92 are provided in the first casing 11 such that to the conveying rollers 91 and 92 respectively define axes oriented in the left-right direction. The conveying rollers 911, 912, 921, and 922 all have substantially the same shape as one another (generally circular shape in a side view). The conveying roller 91 is an example of a driven part.

Figure 6:
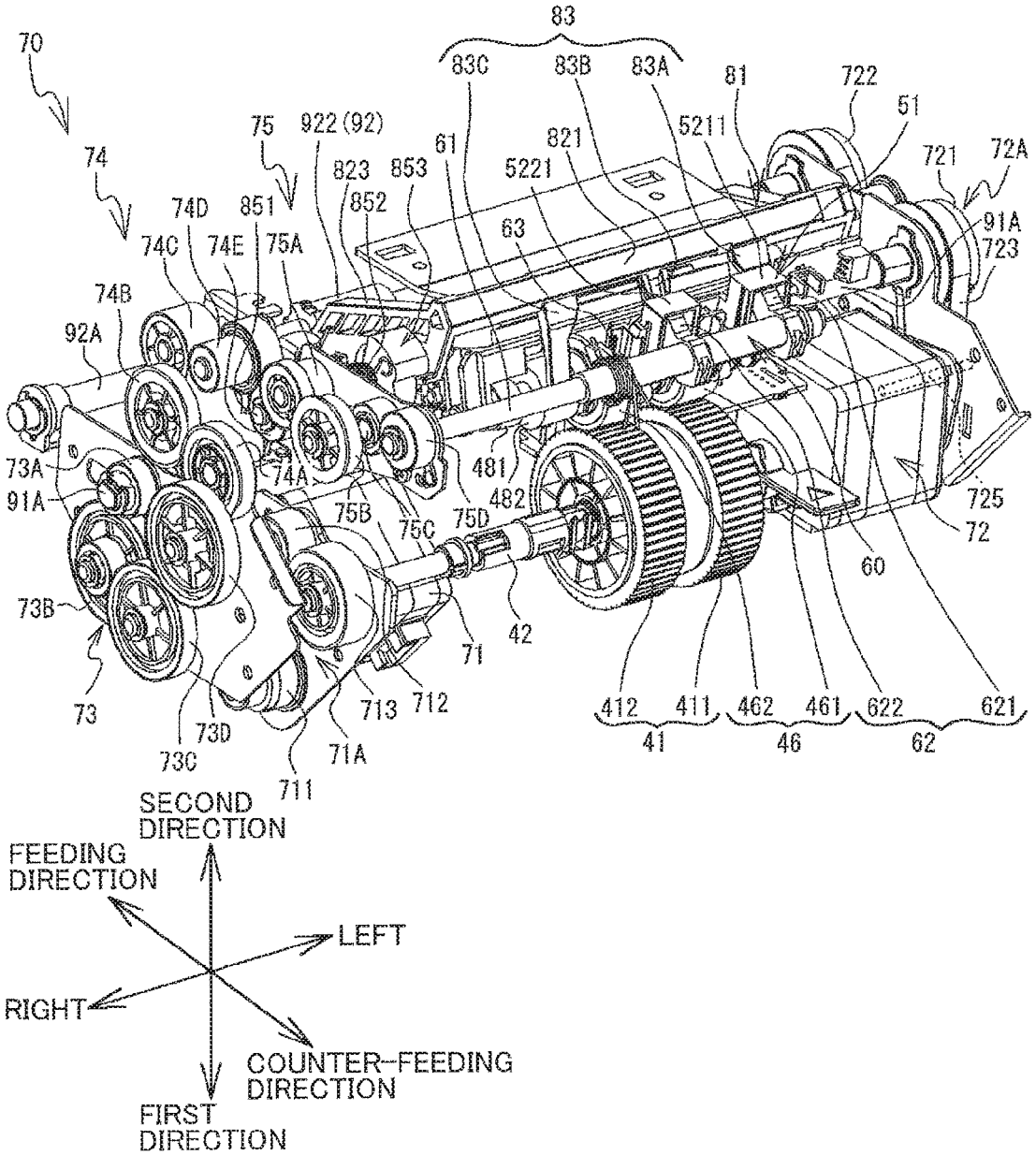
FIG. 6 is a perspective view conceptually illustrating a structure of a drive mechanism 70 provided in the image-reading device 1 according to the embodiment.

Specifically, the conveying roller 91A includes a shaft member 91A extending in the left-right direction, as shown in FIG. 6. The shaft member 91A serves as a rotational shaft of the conveying roller 91. The shaft member 91A is inserted through a center region of the conveying roller 91 in a right side view. Likewise, the conveying roller 92 includes a shaft member 92A extending in the left-right direction and serving as a rotational shaft of the conveying roller 92. The shaft member 92A is inserted through a center region of the conveying roller 92 in a right side view. The conveying rollers 91 and 92 are configured to rotate along with rotation of a drive shaft 725 of the second motor 72 described later. Portions of the respective conveying rollers 91 and 92 protrude through the top surface 11A of the first casing 11 to a position above the top surface 11A.

In the following description, a direction orthogonal to the top surface 11A and from the second casing 12 toward the first casing 11 will be called a first direction, while a direction orthogonal to the top surface 11A and from the first casing 11 toward the second casing 12 will be called a second direction.

<Reverse Roller 46>

The reverse roller 46 is provided in the second casing 12. The reverse roller 46 is configured of two reverse rollers 461 and 462. As shown in FIG. 4, the reverse rollers 461 and 462 are provided on the second-direction side of the feed rollers 411 and 412. The reverse rollers 461 and 462 have substantially the same shape as each other (generally circular shape in a side view). In the following description, the reverse rollers 461 and 462 may also be collectively referred to as the reverse roller 46. The reverse roller 46 defines an axis aligned in the left-right direction. As shown in FIG. 5, the reverse roller 46 has a radius r that is smaller than a radius R of the feed roller 41.

As shown in FIGS. 4 and 5, the reverse roller 46 includes a shaft member 47 extending in the left-right direction and serving as a rotational shaft of the reverse roller 46. The shaft member 47 is provided to penetrate through a center region of the reverse roller 46 when viewed from the right side. The shaft member 47 is rotatably supported in the second casing 12. As shown in FIG. 4, the reverse roller 46 is connected to the shaft member 47 through a torque limiter 482. A gear 481 is coupled to a right end of the shaft member 47. The shaft member 47 is configured to rotate in response to the rotation of the drive shaft 725 of the second motor 72 described later.

A portion of the reverse roller 46 protrudes downward through the lower surface of the second casing 12. As shown in FIGS. 4 and 5, the reverse rollers 461 and 462 respectively contact the feed rollers 411 and 412. The reverse rollers 461 and 462 are urged by urging members (not shown) to be in contact with and pressed against the feed rollers 411 and 412. The conveying path 20 formed by the lower surface of the second casing 12 and top surface 11A of the first casing 11 is specifically defined between the reverse roller 46 and feed roller 41, as shown in FIG. 5. The reverse roller 46 is configured to rotate about a virtual line 47P (an imaginary line shown in FIG. 4 that extends in the left-right direction through a center of the shaft member 47) in response to the rotation of the shaft member 47. The reverse roller 46 can rotate both in the feeding direction and in the counter-feeding direction opposite the feeding direction by the drive force of the second motor 72.

<Pressing Mechanism 50>

The pressing mechanism 50 is provided in the second casing 12. Specifically, as shown in FIG. 4, the pressing mechanism 50 is disposed in on the sides of the reverse roller 46 facing in the counter-feeding direction and the second direction (hereinafter also referred to as the "counter-feeding-direction side" and the "second-direction side"). The pressing mechanism 50 is another example of the driven part.

Further, in the following description, a direction in which the pressing mechanism 50 extends toward the feed roller 41 will be called a third direction, while a direction opposite the third direction will be called a fourth direction.

The pressing mechanism 50 is supported in the second casing 12 through a support member 123. The pressing mechanism 50 includes a pressing member 51, a first spring 54, and an urging unit 55. The pressing member 51 extends through the second casing 12 toward the feed roller 41. The support member 123 supports the pressing member 51 so that the pressing member 51 can move in both the third and fourth directions. The pressing member 51 can oppose the feed roller 41 with the conveying path 20 interposed therebetween.

The pressing member 51 has an end portion on the third-direction side on which a pressure roller 52D is provided. Specifically, the pressure roller 52D is configured of the pressure rollers 521D and 522D. The pressure rollers 521D and 522D are provided respectively on left and right ends of the third-direction side end portion of the pressing member 51. The pressure rollers 521D and 522D respectively define axes aligned in the left-right direction. The left-right centers of the pressure rollers 521D and 522D are substantially aligned with the respective left-right centers of the feed rollers 411 and 412. In the following description, the pressure rollers 521D and 522D may also be collectively referred to as the pressure roller 52D.

The pressing member 51 also includes plate-shaped parts 5211 and 5221 extending in the left-right direction. The plate-shaped parts 5211 and 5221 are provided on an end portion of the pressing member 51 on the fourth-direction side. More specifically, the plate-shaped parts 5211 and 5221 are respectively provided on left and right ends of the fourth-direction side end portion of the pressing member 51.

The first spring 54 and urging unit 55 are provided at the fourth-direction side of the pressing member 51 and the third-direction side of the support member 123. The first spring 54 urges a left-right center portion of the pressing member 51 between the plate-shaped parts 5211 and 5221 to urge the pressing member 51 in the third direction. The urging unit 55 includes a center member 56, and a second spring 57 configured of second springs 571 and 572. In the following description, the second springs 571 and 572 may be collectively referred to as the second spring 57.

The center member 56 has a plate-shaped part 561A occupying a plane aligned in the left-right direction. A hole (not shown) is formed in a left-right center region of the plate-shaped part 561A and penetrates the same in the third direction. The first spring 54 is inserted through this hole in the plate-shaped part 561A to be disposed between the support member 123 and the left-right center portion of the pressing member 51.

The second springs 571 and 572 are disposed to extend in the third direction. The second spring 57 (second springs 571 and 572) is interposed between the support member 123 and the center member 56 in the third direction and fourth direction. Specifically, third-direction side ends of the second springs 571 and 572 are respectively disposed on left and right ends of the plate-shaped part 561A constituting the center member 56. Fourth-direction side ends of the second springs 571 and 572 are respectively supported by the support member 123. The second spring 57 thus urges the center member 56 in the third direction. When urged by the second spring 57, the center member 56 in turn urges the pressing member 51 in the third direction. Hence, the pressing member 51 is urged in the third direction by the urging forces of the first spring 54 and second spring 57 (second springs 571 and 572).

<Cam Member 60>

The cam member 60 is rotatably supported in the second casing 12. Specifically, the cam member 60 is provided on the counter-feeding-direction side of the pressing mechanism 50. As shown in FIG. 6, the cam member 60 includes a shaft member 61, cams 621 and 622, and a spring 63. The shaft member 61 extends in the left-right direction. The shaft member 61 is disposed on the counter-feeding-direction side of the pressing mechanism 50. The shaft member 61 is configured to rotate in response to the rotation of the drive shaft 725 in the second motor 72.

The cams 621 and 622 are provided on the shaft member 61. The cams 621 and 622 have the same shape as each other. In the following description, the cams 621 and 622 will also be collectively referred to as a cam 62. The cam 62 is arranged on the counter-feeding-direction side of the pressing mechanism 50. The cam 62 is a plate cam and protrudes in the feeding direction from the shaft member 61. In accordance with rotation of the shaft member 61, the cams 621 and 622 can contact and separate from the plate-shaped parts 5211 and 5221 of the pressing member 51 constituting the pressing mechanism 50.

The spring 63 is wound about the shaft member 61 at a position farther rightward of the cam 621. The spring 63 urges the shaft member 61 to rotate in the counterclockwise direction.

The pressing member 51 is movable between a pressing position and a retracted position by the functions of the cam member 60, the urging unit 55 and the first spring 54. In the pressing position, the pressure roller 52D of the pressing member 51 protrudes in the first direction from the lower surface of the second casing 12. That is, the pressure roller 52D (a portion of the pressing member 51) interferes with the conveying path 20. The pressure roller 52D is thus capable of pressing the sheets toward the feed roller 41. In the retracted position, the pressure roller 52D is positioned inside the second casing 12. That is, the pressure roller 52D (a portion of the pressing member 51) is retracted from the conveying path 20. The operations for moving the pressing member 51 will be described later.

<Shutter Mechanism 80>

Figure 7:
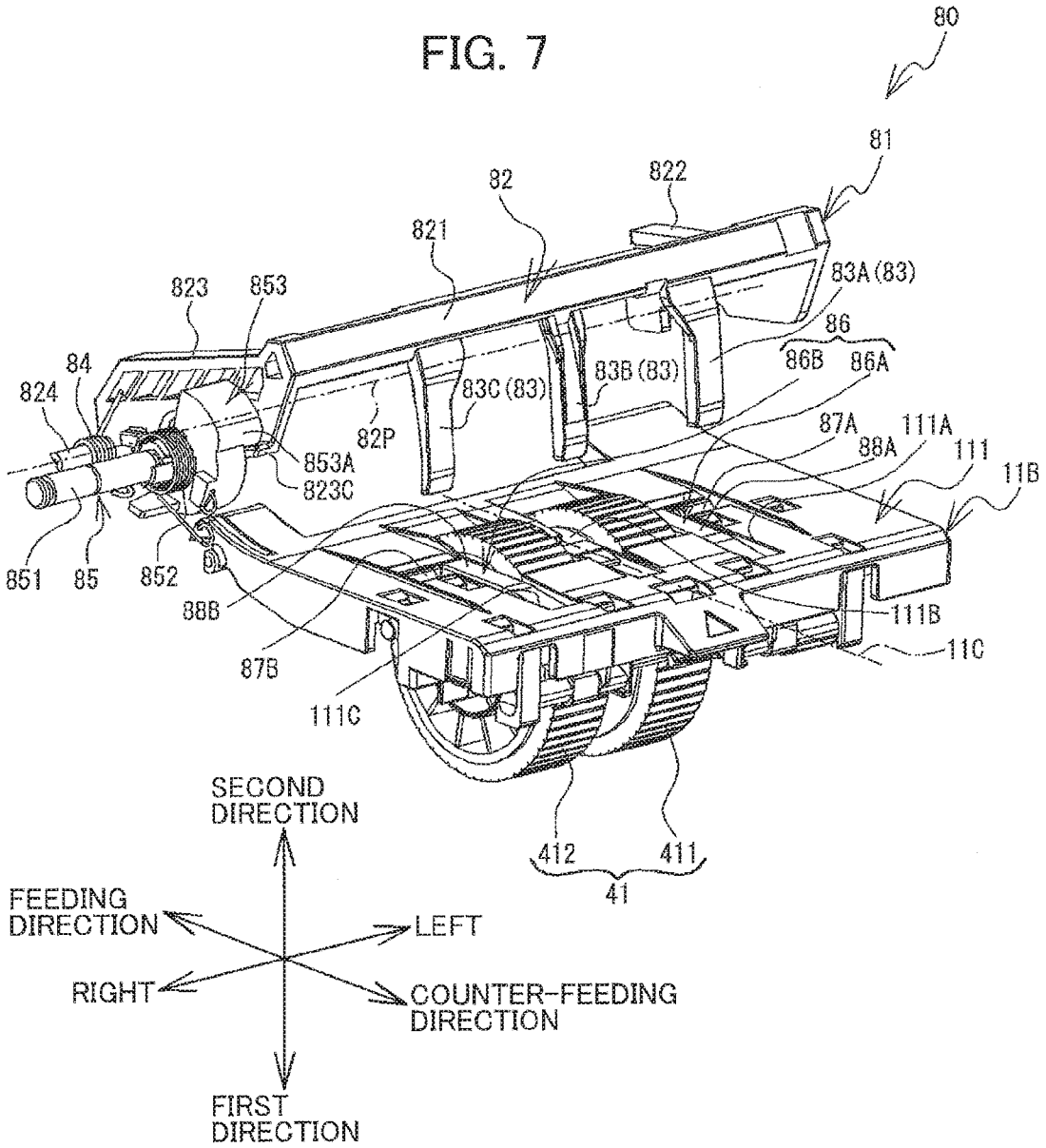
FIG. 7 is a perspective view conceptually illustrating a shutter mechanism 80 provided in the image-reading device 1 according to the embodiment, wherein a shutter 81 of the shutter mechanism 80 is at a non-restricting position.
Figure 8A:
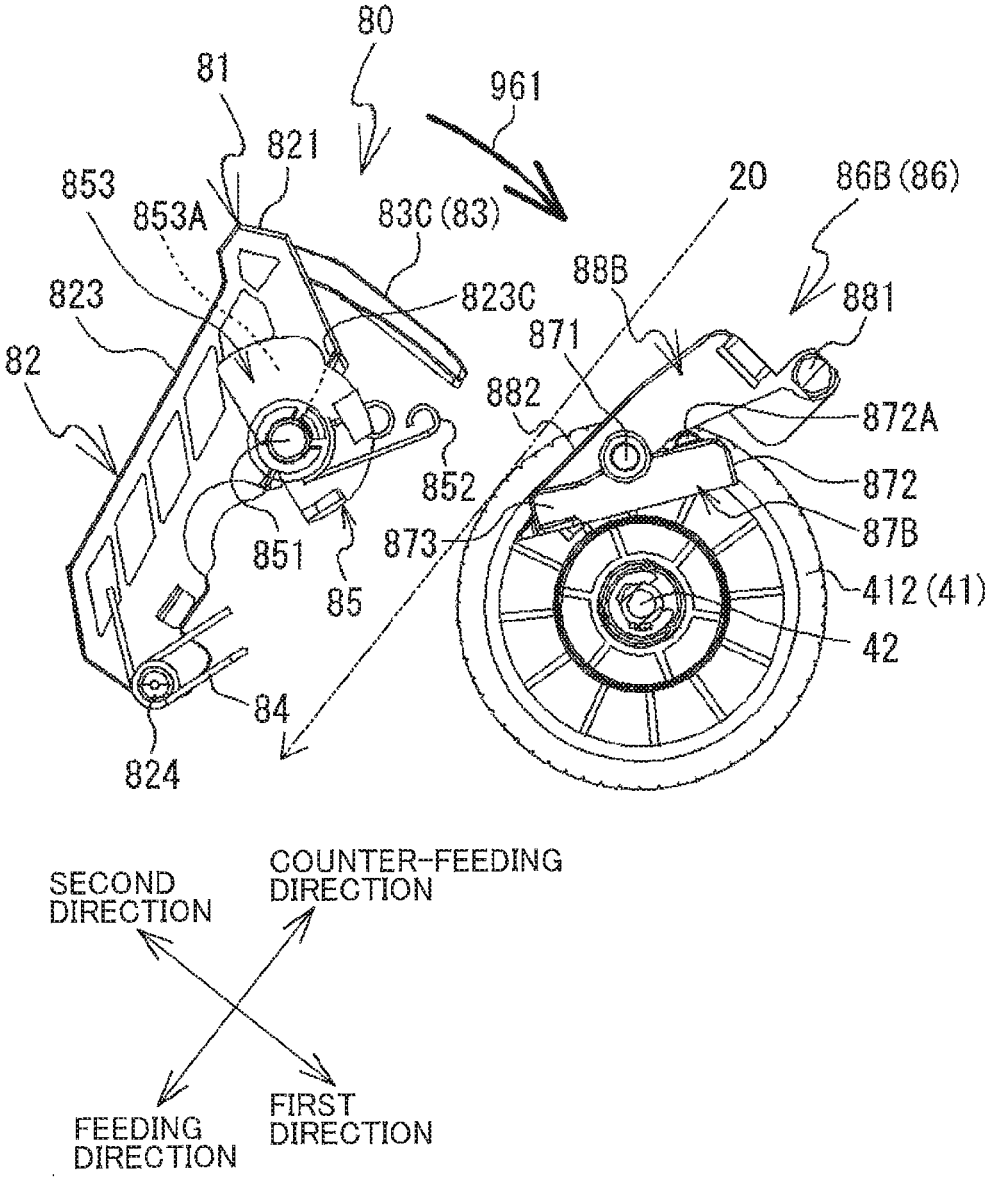
FIG. 8A is a side view explaining a movement of the shutter 81 of the shutter mechanism 80 at the non-restricting position.
Figure 8B:
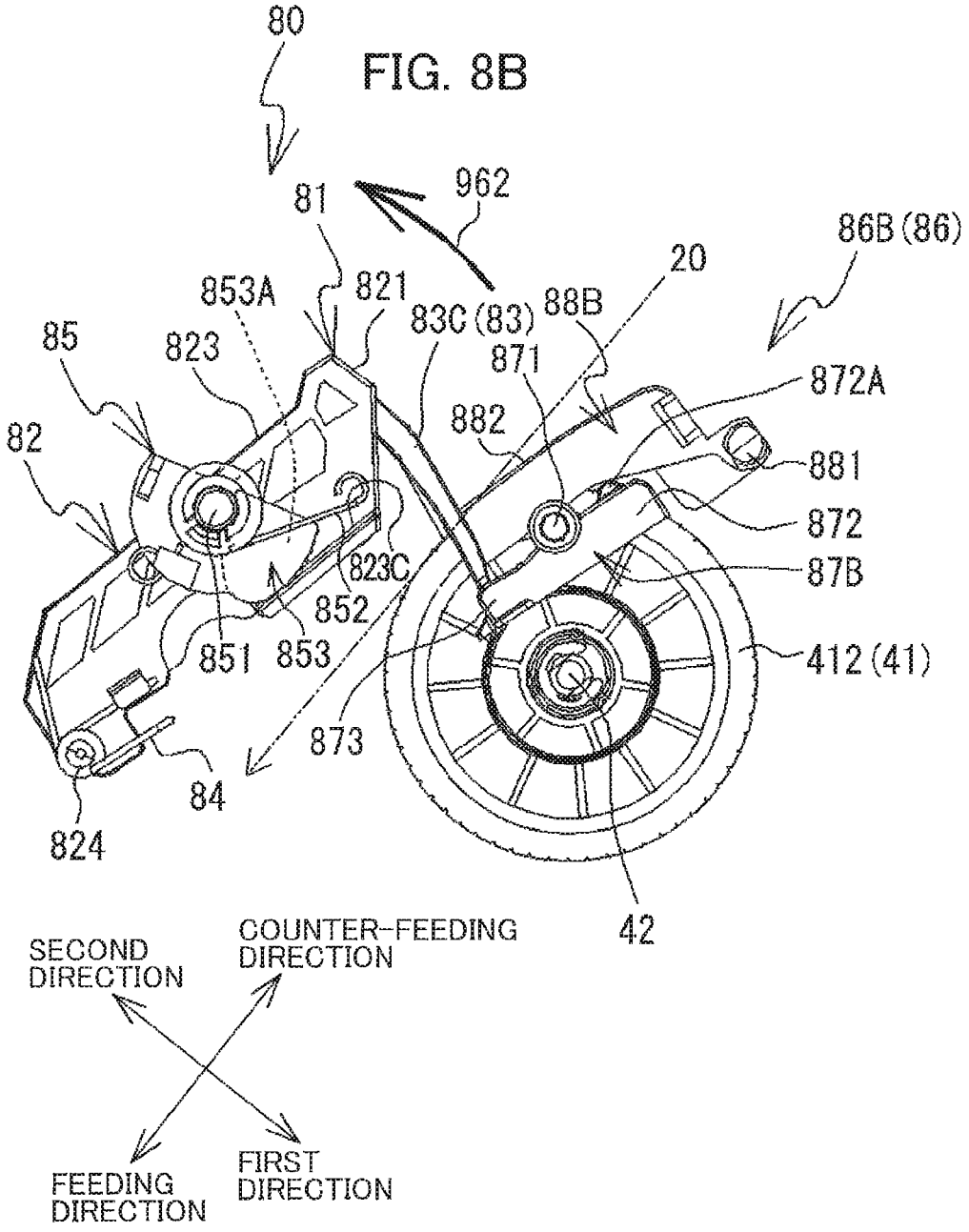
FIG. 8B is a side view explaining the movement of the shutter 81 of the shutter mechanism 80 at a restricting position.

As shown in FIG. 4, the shutter mechanism 80 is provided on the feeding-direction side of the pressing mechanism 50. The shutter mechanism 80 is still another example of the driven part. As shown in FIGS. 7 to 8B, the shutter mechanism 80 includes a shutter 81, a driven portion 85, and the set guide 86. The shutter 81 and driven portion 85 are provided in the second casing 12, while the set guide 86 is provided in the first casing 11.

As shown in FIG. 7, the shutter 81 includes a support member 82, an extension member 83, and a spring 84. The support member 82 has a first portion 821, and second portions 822 and 823. The first portion 821 and second portions 822 and 823 are all disposed in the second casing 12. The first portion 821 is a bar-shaped member that extends in the left-right direction. The second portion 822 extends in the feeding direction from a left end of the first portion 821. The second portion 823 extends in the feeding direction from a right end of the first portion 821.

Shaft parts 824 are respectively provided on feeding-direction side ends of the second portions 822 and 823 to protrude outward therefrom in the left-right direction. Note that only the right shaft part 824 is shown in FIGS. 7 through 8B. The shaft parts 824 are rotatably supported in the second casing 12. The shutter 81 is configured to pivotally move about a virtual line 82P which is an imaginary straight line extending through the shaft parts 824 in the left-right direction.

The spring 84 is wound about the shaft part 824 on the second portion 823 side (i.e., on the right shaft part 824). The spring 84 is a coil spring. The spring 84 has one end fixed to the second portion 823, and another end fixed to the second casing 12. The spring 84 urges the support member 82 to pivotally move in the counterclockwise direction. The second portion 823 has an end portion on the counter-feeding-direction side at which a protruding part 823C is provided. The protruding part 823C protrudes rightward from the counter-feeding-direction side end portion of the second portion 823. The protruding part 823C has a plate-like shape and extends along an edge of the second portion 823 that faces in the first direction.

The extension member 83 is configured of extension parts 83A, 83B, and 83C. The extension part 83A, 83B, and 83C all extend in the first direction from the support member 82. The extension part 83B is disposed between the feed rollers 411 and 412 in the left-right direction. The extension part 83A is arranged on the left side of the feed roller 411, while the extension part 83C is arranged on the right side of the feed roller 412.

The driven portion 85 includes a shaft member 851, a spring 852, and a cam 853. The shaft member 851 is disposed rightward of the second portion 823 constituting the support member 82. The shaft member 851 extends in the left-right direction and is rotatably supported in the second casing 12. The shaft member 851 is configured to rotate in accordance with the rotation of the second motor 72.

The cam 853 is provided on a left end of the shaft member 851. The cam 853 is a plate cam having a semicircular shape. The cam 853 is thus pivotally movable along with the rotation of the shaft member 851. The spring 852 is wound about the shaft member 851 and is positioned to the right of the cam 853. The spring 852 is a coil spring. The spring 852 has one end fixed to the cam 853, and another end fixed to the second casing 12. The spring 852 urges the shaft member 851 to rotate in the counterclockwise direction.

The cam 853 has a left surface on which a protruding part 853A is formed. As shown in FIG. 8A, the protruding part 853A has a general fan shape with a central angle of approximately 60 degrees. The protruding part 853A is configured to contact a surface of the protruding part 823C that faces in the second direction. The protruding part 853A is pivotally movable along with the pivotal movement of the cam 853. The shutter 81 is movable between a non-restricting position shown in FIG. 8A and a restricting position shown in FIG. 8B by the functions of the cam 853 and spring 852. In the restricting position, the extension member 83 (extension parts 83A, 83B, and 83C) of the shutter 81 extends across the conveying path 20 from the second-direction side toward the first-direction side. In the non-restricting position, the extension member 83 (extension parts 83A, 83B, and 83C) is retracted (spaced away) from the conveying path 20 in the second direction. The operations for moving the shutter 81 will be described later.

Next, the set guide 86 will be described. As shown in FIG. 7, the support member 11B is arranged around the feed roller 41. The support member 11B has a surface 111 facing in the second direction that forms part of the top surface 11A (left-right center and rearward portion of the top surface 11A), as shown in FIG. 2. Openings 111A, 111B, and 111C are formed in the surface 111 of the support member 11B. The opening 111A is formed to the left of the centerline 11C; the opening 111C is formed to the right of the centerline 11C; and the opening 111B is formed along the centerline 11C. The support member 11B supports the set guide 86 on the first-direction side of the surface 111.

The set guide 86 includes set guides 86A and 86B. The set guide 86A is disposed leftward of the feed roller 411, while the set guide 86B is disposed rightward of the feed roller 412. The set guides 86A and 86B have symmetrical shapes with respect to the left-right direction. For this reason, only the set guide 86B will be described in detail below, while a description of the set guide 86A will be simplified.

As shown in FIGS. 8A and 8B, the set guide 86B includes a first member 87B, and a second member 88B. The first member 87B and second member 88B extend in the feeding direction. The first member 87B is disposed on the right side of the second member 88B. The first member 87B has a center portion in the feeding direction on which a shaft part 871 is provided. The shaft part 871 is oriented in the left-right direction and is rotatably supported in the first casing 11. The first member 87B can pivot about the shaft part 871. The first member 87B has an end portion 872 on the counter-feeding-direction side that extends leftward and advances beneath the second member 88B. On the end portion 872, a protruding part 872A is provided to protrude upward therefrom. The protruding part 872A is in contact with a bottom surface of the second member 88B.

The second member 88B has an end portion in the counter-feeding direction on which a shaft part 881 is provided. The shaft part 881 extends in the left-right direction. The shaft part 881 is also positioned downstream of the first member 87B in the counter-feeding direction. The shaft part 881 is rotatably supported in the first casing 11. The second member 88B can thus pivotally move about the shaft part 881. The second member 88B is supported from below by the protruding part 872A of the first member 87B. As shown in FIG. 7, portions of the first member 87B and second member 88B are exposed through the opening 111C. The second member 88B has a surface 882 facing in the second direction (hereinafter, called "second-direction-side surface 882").

Likewise, as shown in FIG. 7, the set guide 86A includes a first member 87A, and a second member 88A. The first member 87A and second member 88B correspond to the first member 87B and second member 88B of the set guide 86B. Portions of the first member 87A and second member 88A are exposed through the opening 111A. When the shutter 81 moves to the restricting position, the set guide 86 moves to a first guiding position shown in FIG. 8B. When the shutter 81 moves to the non-restricting position, the set guide 86 moves to a second guiding position shown in FIG. 8A. The operations for moving the set guide 86 will be described later.

<Drive Mechanism 70>

As shown in FIG. 6, the drive mechanism 70 includes the first motor 71, the second motor 72, and transmission mechanisms 71A, 72A, 73, 74, and 75. The first motor 71, second motor 72, and transmission mechanisms 71A, 72A, and 73 are provided in the first casing 11, while the transmission mechanisms 74 and 75 are provided in the second casing 12.

The first motor 71 is provided in a right end portion of the first casing 11. The first motor 71 has a drive shaft (not shown) that extends in the left-right direction (rightward). The transmission mechanism 71A includes gears 711, 712, 713; a belt (not shown); and the shaft member 42. The gears 711, 712, and 713 and the belt are disposed on the right side of the first motor 71, and are configured to rotate when the drive shaft of the first motor 71 is driven to rotate. The gear 713 is connected to a right end of the shaft member 42. The transmission mechanism 71A is thus configured to transmit the drive force of the first motor 71 to the feed roller 41. That is, the transmission mechanism 71A can transmit the drive force for rotating the feed roller 41 in the feeding direction.

The second motor 72 is provided in a left end portion of the first casing 11. The second motor 72 has the drive shaft 725 that extends in the left-right direction (leftward). As will be described later, when the drive shaft 725 rotates in a forward direction, the conveying roller 91 rotates in the counter-feeding direction while the reverse roller 46 rotates in the feeding direction. Conversely, when the drive shaft 725 rotates in a reverse direction, the conveying rollers 91 and 92 rotate in the feeding direction while the reverse roller 46 rotates in the counter-feeding direction.

The transmission mechanism 72A is disposed on the left side of the second motor 72. The transmission mechanism 72A includes gears 721 and 722, and a belt 723. The belt 723 is mounted over the gears 721 and 722 to be looped around the same. The gears 721 and 722, and the belt 723 are configured to rotate when the drive shaft 725 of the second motor 72 rotates.

The gear 721 is connected to a left end of the shaft member 91A of the conveying roller 91. The gear 722 is connected to a left end of the shaft member 92A of the conveying roller 92. The transmission mechanism 72A can thus transmit a drive force of the second motor 72 to the shaft member 91A and shaft member 92A. That is, the conveying rollers 91 and 92 can rotate in response to the rotation of the second motor 72.

The gear 722 includes an internal one-way clutch. When the second motor 72 rotates in the reverse direction, the one-way clutch of the gear 722 transmits the drive force of the second motor 72 to the shaft member 92A, causing the conveying roller 92 to rotate in the counterclockwise direction, i.e., the feeding direction. However, when the second motor 72 rotates in the forward direction, the one-way clutch of the gear 722 allows the shaft member 92A to freewheel relative to the gear 722. Hence, in this case, the drive force of the second motor 72 is not transmitted to the conveying roller 92.

On the other hand, the gear 721 does not possess a one-way clutch. Accordingly, when the second motor 72 rotates in the reverse direction, the gear 721 can transmit the drive force of the second motor 72 to the shaft member 91A, causing the conveying roller 91 to rotate counterclockwise, i.e., in the feeding direction. When the second motor 72 rotates in the forward direction, the gear 721 transmits the drive force of the second motor 72 to the shaft member 91A, causing the conveying roller 91 to rotate clockwise, i.e., in the counter-feeding direction.

The transmission mechanism 72A can thus transmit the drive force of the second motor 72 to the conveying rollers 91 and 92.

The transmission mechanism 73 includes gears 73A, 73B, 73C, and 73D. The gear 73A is engaged with the gear 73B, the gear 73B with the gear 73C, and the gear 73C with the gear 73D. The gear 73A is coupled to the right end of the shaft member 91A in the conveying roller 91. The gears 73A, 73B, 73C, and 73D can rotate in response to the rotation of the shaft member 91A. The transmission mechanism 73 can transmit the drive force of the second motor 72, which is transmitted from the shaft member 91A, to the transmission mechanism 74.

The transmission mechanism 74 includes gears 74A, 74B, 74C, 74D, 74E, the gears 471, 472, and 481; and the torque limiter 482. The gear 74A is configured to be engaged with the gear 73D of the transmission mechanism 73 when the second casing 12 is placed in the closed position shown in FIG. 1. The gear 74A is configured to be separated from the gear 73D of the transmission mechanism 73 when the second casing 12 is rotated to its open position (not shown). The following description will be based on the second casing 12 being in its closed position. The gear 74A is engaged with the gear 74B, the gear 74B with the gear 74C, the gear 74C with the gear 74D, and the gear 74D with the gear 74E. As shown in FIG. 4, the gear 471 is engaged with the gear 472, and the gear 472 with the gear 481. The gear 481 is coupled to the shaft member 47 which is connected to the reverse roller 46 through the torque limiter 482, as described earlier. The gear 471 has a rotational shaft 470 that extends rightward therefrom and is connected to a gear (not shown) included in the transmission mechanism 74.

The gear 74B is connected to the shaft member 47 of the reverse roller 46 via gears (not shown) included in the transmission mechanism 74; the gears 471, 472, and 481; and the torque limiter 482. That is, the drive force of the second motor 72 can be transmitted to the reverse roller 46 via the transmission mechanism 72A; shaft member 91A; transmission mechanism 73; gears 74A, 74B, 471, 472 and 481; and torque limiter 482.

When the drive shaft 725 of the second motor 72 rotates in the reverse direction, the drive force of the second motor 72 is transmitted to the shaft member 47, causing the reverse roller 46 to rotate counterclockwise, i.e., in the counter-feeding direction. When the drive shaft 725 of the second motor 72 rotates in the forward direction, the drive force of the second motor 72 is transmitted to the shaft member 47, causing the reverse roller 46 to rotate clockwise, i.e., in the feeding direction.

The torque limiter 482 is configured to connect the shaft member 47 and reverse roller 46 when a rotational torque applied to the reverse roller 46 is within a prescribed threshold value. The torque limiter 482 is configured to disconnect the shaft member 47 and reverse roller 46 when the rotational torque applied to the reverse roller 46 exceeds the prescribed threshold value.

The gear 74E is connected to the shaft member 851 of the driven portion 85 shown in FIG. 7. Thus, the drive force of the second motor 72 can be transmitted to the driven portion 85 via the transmission mechanism 72A, shaft member 91A, and transmission mechanisms 73 and 74. The gear 74E has an internal one-way clutch. When the second motor 72 rotates in the forward direction, the one-way clutch of the gear 74E is configured to transmit the drive force of the second motor 72 to the shaft member 851, causing the cam 853 to pivot clockwise. However, when the second motor 72 rotates in the reverse direction, the one-way clutch of the gear 74E allows the shaft member 851 to freewheel relative to the gear 74E. In this case, the drive force of the second motor 72 is not transmitted to the cam 853.

The transmission mechanism 74 can transmit the drive force of the second motor 72, which is transmitted from the transmission mechanism 73, to the reverse roller 46 and driven portion 85 of the shutter 81.

The transmission mechanism 75 includes gears 75A, 75B, 75C, and 75D. The gear 74E of the transmission mechanism 74 is engaged with the gear 75A, the gear 75A with the gear 75B, the gear 75B with the gear 75C, and the gear 75C with the gear 75D.

The gear 75D is connected to the shaft member 61 of the cam member 60. The drive force of the second motor 72 can be thus transmitted to the cam member 60 via the transmission mechanism 72A, the shaft member 91A, and the transmission mechanisms 73, 74, and 75. The gear 75D has an internal one-way clutch. When the drive shaft 725 of the second motor 72 rotates in the forward direction, the one-way clutch of the gear 75D is configured to transmit the drive force of the second motor 72 to the shaft member 61, causing the cam 62 to rotate clockwise. However, when the drive shaft 725 of the second motor 72 rotates in the reverse direction, the one-way clutch of the gear 75D allows the shaft member 61 to freewheel relative to the gear 75D. In this case, the drive force of the second motor 72 is not transmitted to the cam 62.

3. Operations of the Image-Reading Device 1

Next, operations executed by the controller 131 of the image-reading device 1 will be described mainly with reference to FIG. 9.

When the power to the image-reading device 1 is turned on, the CPU of the controller 131 is configured to read a control program from the ROM and develop the program in the RAM. The CPU of the controller 131 is configured to execute processes based on this control program to enable the controller 131 to control the image-reading device 1.

First, the controller 131 is configured to control the image-reading device 1 to perform a preliminary operation. In this preliminary operation, the controller 131 controls the drive shaft 725 of the second motor 72 to rotate in the forward direction, thereby placing the shutter 81 in the restricting position, the set guide 86 in the first guiding position, and the pressing member 51 in the retracted position. When the drive shaft 725 of the second motor 72 rotates in the forward direction, the reverse roller 46 also rotates in the feeding direction. At this time, the controller 131 also rotates the drive shaft of the first motor 71 so that the feed roller 41 is rotated in the feeding direction, i.e., the same direction as the reverse roller 46.

Figure 9:
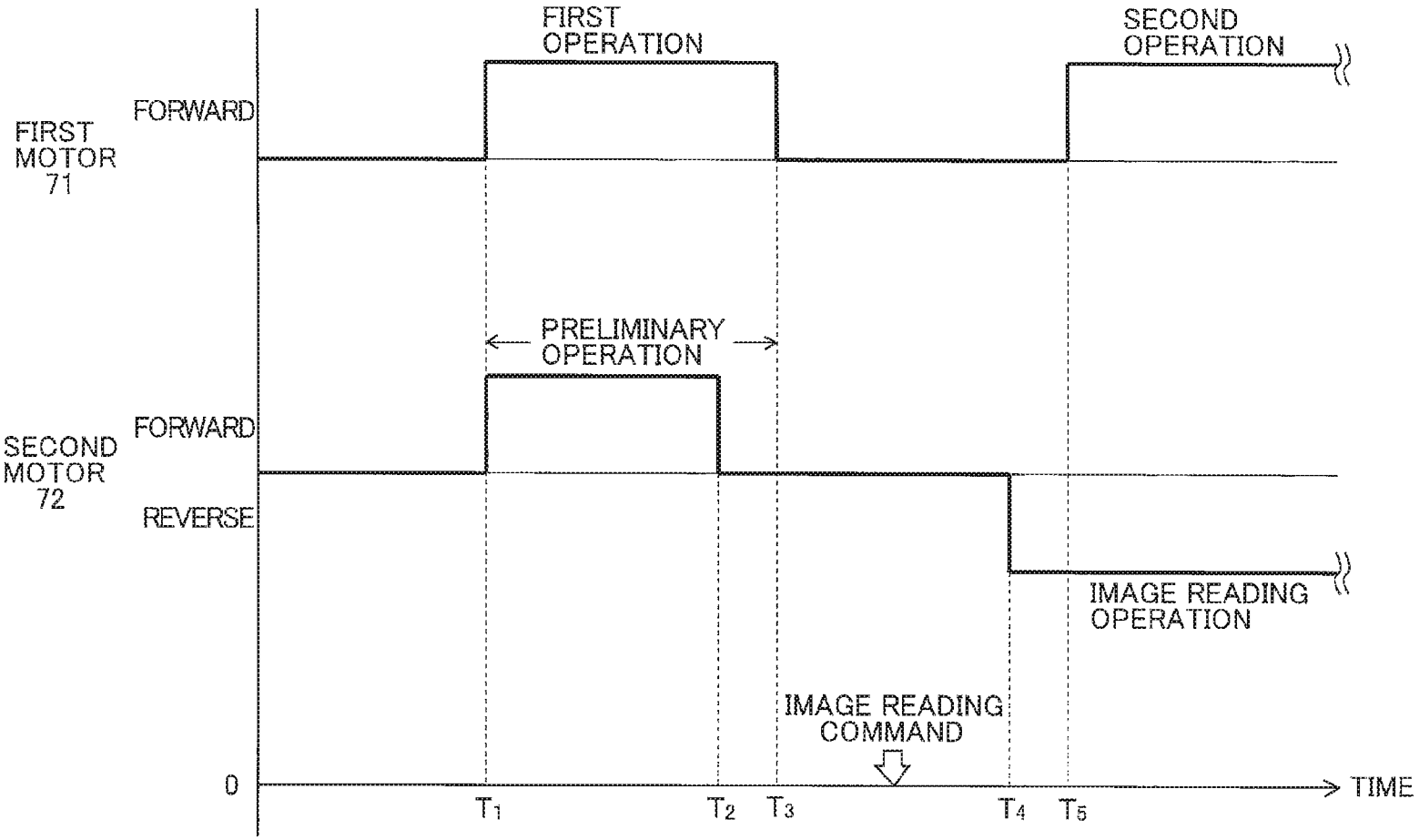
FIG. 9 is a timing chart explaining how a first motor 71 and a second motor 72 are driven according to the embodiment.

More specifically, referring to FIG. 9, the controller 131 first rotates the second motor 72 in the forward direction at a timing T1. The drive force of the second motor 72 is transmitted to the gear 74E via the transmission mechanism 72A, shaft member 91A, transmission mechanism 73, and gears 74A-74D in the transmission mechanism 74. Also when the drive shaft 725 of the second motor 72 rotates in the forward direction, the one-way clutch of the gear 74E transmits the drive force of the second motor 72 to the shaft member 851 of the driven portion 85. Accordingly, the cam 853 of the driven portion 85 is caused to pivot clockwise against the urging force of the spring 852.

When the cam 853 pivots clockwise, the protruding part 853A of the cam 853 presses the protruding part 823C of the second portion 823, forcing the support member 82 of the shutter 81 to pivot clockwise against the urging force of the spring 84, as indicated by an arrow 961 in FIG. 8A. Thus, the shutter 81 is now set in its restricting position as shown in FIG. 8B. In the restricting position, the extension parts 83A, 83B, and 83C lay across the conveying path 20 from the second-direction side toward the first-direction side. That is, the extension member 83 (a portion of the shutter 81) intersects with the conveying path 20. The extension parts 83A and 83C press downward on feeding-direction-side ends 873 of the first members 87A and 87B constituting set guides 86A and 86B, respectively. Consequently, the first members 87A and 87B are pivotally moved counterclockwise about the respective shaft parts 871, causing the protruding parts 872A of first members 87A and 87B to push the second members 88A and 88B upward. The second members 88A and 88B are thus pivotally moved clockwise about the respective shaft parts 881, causing feeding-direction-side ends of the second members 88A and 88B to move in the second direction. Hence, feeding-direction-side ends on the second-direction-side surfaces 882 of the second members 88A and 88B are positioned further downstream of the feed roller 41 in the second-direction. That is, the set guide 86 is placed in the first guiding position.

In the meantime, the drive force of the second motor 72 is also transmitted to the gear 75D via the transmission mechanism 72A, shaft member 91A, transmission mechanisms 73 and 74, and gears 75A-75C. When the second motor 72 rotates in the forward direction, the one-way clutch of the gear 75D transmits the drive force of the second motor 72 to the shaft member 61 of the cam member 60. Accordingly, the shaft member 61 is rotated clockwise against the urging force of the spring 63 to pivotally move the cam 62 clockwise.

When the cam 62 pivots clockwise, the cams 621 and 622 are respectively brought into contact with the bottoms surfaces of the plate-shaped parts 5211 and 5221 of the pressing member 51. As the cam 62 pivots, a force in the fourth direction is applied to the pressing member 51. Consequently, the pressing member 51 is moved in the fourth direction, as indicated by an arrow 972 in FIG. 5, against the urging forces of the first spring 54 and urging unit 55 until arriving at the retracted position. In the retracted position, the pressing member 51 is positioned farther in the fourth direction than the lower surface of the second casing 12. The pressure roller 52D (pressure rollers 521D and 522D) does not protrude from the lower surface of the second casing 12 into the conveying path 20 at this time. That is, the pressure roller 52D (a portion of the pressing member 51) is spaced away from the conveying path 20.

In response to the rotation of the second motor 72 in the forward direction, the one-way clutch of the gear 722 in the transmission mechanism 72A allows the shaft member 92A to freewheel. Consequently, the drive force of the second motor 72 is not transmitted to the shaft member 92A and, hence, the conveying roller 92 does not rotate. However, the gear 721 of the transmission mechanism 72A rotates the shaft member 91A clockwise when the second motor 72 rotates in the forward direction. Accordingly, the drive force of the second motor 72 is transmitted to the shaft member 91A, rotating the conveying roller 91 counterclockwise.

The drive force of the second motor 72 is also transmitted to the shaft member 47 via the transmission mechanism 72A, shaft member 91A, transmission mechanism 73, gears 74A and 74B of the transmission mechanism 74, and gears 471, 472, and 481. Consequently, the drive force of the second motor 72 is transmitted to the reverse roller 46, rotating the reverse roller 46 in the feeding direction indicated by an arrow 951 in FIG. 5.

Concurrently with driving the drive shaft 725 of the second motor 72 in the forward direction, the controller 131 also rotates the drive shaft of the first motor 71 at the timing T1. The drive force of the first motor 71 is transmitted to the feed roller 41 via the transmission mechanism 71A. Hence, when the drive shaft 725 of the second motor 72 rotates in the feeding direction (forward direction) causing the reverse roller 46 to rotate in the feeding direction and driving the shutter 81 and pressing member 51, the feed roller 41 undergoes a first operation through which the transmission mechanism 71A drives the feed roller 41 to rotate in the feeding direction indicated by an arrow 981 in FIG. 5. At this time, the pin 421 of the shaft member 42 contacts the wall portion 416 on the feeding-direction side of the opening part 415 so that the drive force of the first motor 71 is transmitted to the feed roller 41, as illustrated in FIG. 5.

Specifically, when the feed roller 41 undergoes the first operation, the feed roller 41 is configured to be rotated by the transmission mechanism 71A such that a condition indicated in Equation (1) below is met.

$$A > C \times r/R \qquad \text{Equation (1)}$$

In the above Equation (1), A denotes a number of rotations per unit time of the shaft member 42, i.e., the rotational shaft of the feed roller 41, during the first operation; C denotes a number of rotations per unit time of the shaft member 47, i.e., the rotational shaft of the reverse roller 46, during the first operation; r denotes the radius of the reverse roller 46; and R denotes the radius of the feed roller 41. When the Equation (1) is satisfied, the rotational speed of the feed roller 41 is greater than the rotational speed of the reverse roller 46. Accordingly, the feed roller 41 is unlikely to follow the rotation of the reverse roller 46, thereby enabling the pin 421 of the shaft member 42 to contact the wall portion 416 of the opening part 415.

In the present embodiment, the controller 131 is configured to initiate a first operation process for controlling the feed roller 41 to start performing the first operation at the timing T1 at the same time as the controller 131 rotates the drive shaft 725 of the second motor 72 in the forward direction. Further, the controller 131 is also configured to initially stop driving the drive shaft 725 of the second motor 72 in the forward direction at a timing T2 to halt the reverse roller 46 and subsequently stop driving the first motor 71 at a timing T3 to halt rotation of the feed roller 41 through the transmission mechanism 71A. In other words, the controller 131 is configured to halt the rotation of the feed roller 41 in the feeding direction through the transmission mechanism 71A at the timing T3 after halting the forward rotation of the drive shaft 725 of the second motor 72 at the timing T2. That is, at the timing T3, the first operation ends. At the moment the first operation ends, the pin 421 remains in contact with the wall portion 416 on the feeding direction side of the opening part 415, as illustrated in FIG. 5.

After the preliminary operation is executed as described above at the timing T3, the user next places a plurality of sheets in the sheet-feed tray 16. Edges of the sheets positioned downstream in the feeding direction enter into the feed opening 10A. Once the sheets have been placed in the sheet-feed tray 16, a sheet sensor 125 (refer to FIG. 3) is configured to detect the sheets and transmit a detection signal to the controller 131. As a result, the controller 131 can detect that sheets are present in the sheet-feed tray 16.

At this time, the pressing member 51 is in the retracted position. Consequently, the sheets entering the conveying path 20 do not contact the pressure roller 52D of the pressing member 51. As shown in FIG. 8B, the feeding-direction ends of the second-direction-side surfaces 882 on the second members 88A and 88B constituting the set guide 86 are positioned on the second direction side relative to the conveying path 20. Accordingly, the sheets contact the second-direction-side surfaces 882 on the second members 88A and 88B rather than contacting the feed roller 41. Further, the shutter 81 is in the restricting position, whereby the extension member 83 crosses the conveying path 20 at a position further downstream in the counter-feeding direction than the point of contact between the feed roller 41 and reverse roller 46. Thus, the extension member 83 can restrict the sheets from moving in the feeding direction, thereby preventing the sheets from reaching the point of contact between the feed roller 41 and reverse roller 46.

Here, assume that the user operates the operating unit 122 on the second casing 12 or a personal computer or other processor (not shown) to input a command to begin reading image(s) on the sheet(s). Upon detecting the command to begin reading, the controller 131 controls the image-reading device 1 to perform an image reading operation.

Briefly, in the image reading operation, the controller 131 is configured to rotate the drive shaft 725 of the second motor 72 in the reverse direction, moving the shutter 81 to the non-restricting position shown in FIG. 8A, moving the set guide 86 to the second guiding position shown in FIG. 8A, and moving the pressing member 51 to the pressing position. Also, when the drive shaft 725 of the second motor 72 rotates in the reverse direction, the reverse roller 46 rotates in the counter-feeding direction and the conveying rollers 91 and 92 rotate in the feeding direction. The controller 131 further rotates the drive shaft of the first motor 71 for rotating the feed roller 41 in the feeding direction. Through these operations, the separating function is activated and an image on a sheet is read.

Specifically, the controller 131 rotates the drive shaft 725 of the second motor 72 in the reverse direction at a timing T4. The drive force of the second motor 72 is transmitted to the gear 74E via the transmission mechanism 72A, shaft member 91A, transmission mechanism 73, and gears 74A-74D of the transmission mechanism 74, as illustrated in FIG. 6. When the second motor 72 rotates in the reverse direction, the one-way clutch in the gear 74E allows the shaft member 851 of the driven portion 85 to freewheel. Accordingly, the cam 853 of the driven portion 85 is pivotally moved counterclockwise by the urging force of the spring 852.

When the cam 853 is pivoted counterclockwise, the urging force of the spring 84 causes the shutter 81 to pivot counterclockwise in a direction indicated by an arrow 962 in FIG. 8B. This operation places the shutter 81 in the non-restricting position shown in FIG. 8A, and separates the extension parts 83A and 83C from the first members 87A and 87B of the corresponding set guides 86A and 86B. The extension member 83 is thus retracted from the conveying path 20. The first members 87A and 87B are hence pivotally moved clockwise by the weight of their ends 872. Consequently, the second-direction-side surfaces 882 on the second members 88A and 88B are moved to the first-direction side relative to the surface 111 on the support member 11B. In other words, the set guide 86 moves to its second guiding position.

The drive force of the second motor 72 is also transmitted to the gear 75D via the transmission mechanism 72A, shaft member 91A, transmission mechanisms 73 and 74, and gears 75A-75C of the transmission mechanism 75. When the second motor 72 rotates in the reverse direction, the one-way clutch of the gear 75D allows the shaft member 61 of the cam 62 to freewheel. Accordingly, the shaft member 61 is rotated counterclockwise by the urging force of the spring 63 and the cam 62 is pivotally moved counterclockwise. When the cam 62 pivots counterclockwise, the cams 621 and 622 respectively separate from plate-shaped parts 5211 and 5221 of the pressing member 51. The urging forces of the first spring 54 and urging unit 55 move the pressing member 51 in the third direction indicated by an arrow 971 in FIG. 5. Thus, the pressure roller 52D of the pressing member 51 moves to the pressing position, protruding farther in the first direction than the lower surface of the second casing 12. By moving to the pressing position, the pressure roller 52D presses the sheets on the sheet-feed tray 16 toward the feed roller 41. This arrangement ensures a better separating and conveying operation with the feed roller 41 and reverse roller 46 than when the pressure roller 52D does not apply pressure to the sheets.

In response to the rotation of the drive shaft 725 of the second motor 72 in the reverse direction, the one-way clutch in the gear 722 of the transmission mechanism 72A transmits the drive force of the second motor 72 to the shaft member 92A, thereby rotating the conveying roller 92 counterclockwise, i.e., in the feeding direction. Further, in response to the rotation of the drive shaft 725 of the second motor 72 in the reverse direction, the gear 721 of the transmission mechanism 72A rotates the shaft member 91A counterclockwise. Consequently, the drive force of the second motor 72 is transmitted to the shaft member 91A, rotating the conveying roller 91 counterclockwise, i.e., in the feeding direction.

The drive force of the second motor 72 is also transmitted to the shaft member 47 via the transmission mechanism 72A, shaft member 91A, transmission mechanism 73, gears 74A and 74B of the transmission mechanism 74, and gears 471, 472 and 481. As a result, the reverse roller 46 rotates counterclockwise in a direction indicated by an arrow 952 in FIG. 5, i.e., in the counter-feeding direction. However, since the pin 421 of the shaft member 42 is in contact with the wall portion 416 on the feeding-direction side of the opening part 415 at this time, the feed roller 41 does not follow the rotation of the reverse roller 46. Accordingly, sheets contacted by the feed roller 41 do not move in the counter-feeding direction, ensuring a favorable separating and conveying operation.

Subsequently, at a timing T5, the controller 131 rotates the drive shaft of the first motor 71. At this time, the transmission mechanism 71A transmits the drive force of the first motor 71 to the shaft member 42, causing the feed roller 41 to rotate in the feeding direction indicated by the arrow 981 in FIG. 5. In this way, the feed roller 41 is configured to perform a second operation, after the feed roller 41 has completed the first operation (at the timing T3) and the drive shaft 725 of the second motor 72 rotates in the reverse direction (at the timing T4) to cause the reverse roller 46 to rotate in the counter-feeding direction. In the second operation, the feed roller 41 is rotated in the feeding direction by the transmission mechanism 71A.

Note that it is preferable that the controller 131 is configured to wait for a prescribed period of time to elapse after starting to drive the drive shaft 725 of the second motor 72 before rotating the drive shaft of the first motor 71. This prescribed period of time (a length of time between the timing T4 and the timing T5) should be set to be equal to or more than a time duration required for the shutter 81 to move to its non-restricting position. In other words, preferably, the controller 131 is configured to start driving the first motor 71 so that the feed roller 41 can execute its second operation after the shutter 81 has been moved to the non-restricting position. The process performed by the controller 131 for controlling the feed roller 41 to execute the second operation will be called a second operation process.

When the shutter 81 moves to its non-restricting position, the plurality of sheets on the sheet-feed tray 16 is allowed to move down the conveying path 20 in the feeding direction. At this time, the second-direction-side surfaces 882 on the second members 88A and 88B constituting the set guide 86 are disposed on the first-direction side of the conveying path 20 since the set guide 86 is in its second guiding position. Accordingly, the feed roller 41 contacts a bottommost sheet among the plurality of sheets moving down the conveying path 20 in the feeding direction from the first-direction side. Further, the pressure roller 52D presses the sheets from the second-direction side against the feed roller 41. By the rotating feed roller 41 and reverse roller 46, the single bottommost sheet can be separated from the plurality of sheets and moved downstream in the feeding direction.

The conveying roller 91 contacts the bottom surface (i.e., surface facing in the first direction) of the separated sheet once the sheet has moved downstream in the feeding direction and continues to convey the sheet in the feeding direction. The image reader 93 (see FIG. 2) disposed further downstream of the conveying roller 91 in the feeding direction reads the image on the bottom surface of the sheet, as the sheet moves over the image reader 93. The controller 131 receives output signals transmitted from the image reader 93 and converts the signals to digital data. Next, the conveying roller 92, which is disposed downstream of the image reader 93 in the feeding direction, contacts the bottom surface of the sheet exiting the image reader 93 and continues to convey the sheet further downstream in the feeding direction. The conveying roller 92 discharges the sheet from the casing 10 through the discharge opening 10B into the discharge tray 18.

4. Operational and Advantageous Effects of the Embodiment

While the image-reading device 1 according to the embodiment performs the operations described above, consider a case in which the first operation is not executed. In this case, referring to FIG. 10, when the reverse roller 46 rotates in the feeding direction indicated by the arrow 951, the feed roller 41 is caused to follow this rotation of the reverse roller 46 in the feeding direction as indicated by the arrow 981. Since the first motor 71 is not driven at this time and, hence, the drive force is not transmitted from the first motor 71 to the shaft member 42, the wall portion 417 on the counter-feeding-direction side of the opening part 415 remains in contact with the pin 421 of the shaft member 42 so that both the feed roller 41 and shaft member 42 rotate in the feeding direction. Consequently, after the reverse roller 46 stops rotating, a gap 418 is formed between the wall portion 416 on the feeding-direction side of the opening part 415 and the pin 421 of the shaft member 42. That is, the gap 418 is formed on the counter-feeding-direction side relative to the wall portion 416 of the opening part 415 of the feed roller 41. Due to the presence of this gap 418, the feed roller 41 may be caused to rotate in the counter-feeding direction indicated by an arrow 982 in FIG. 10 in response to the rotation of the reverse roller 46 in the counter-feeding direction indicated by the arrow 952 at the timing T4 in order for activating the separating function. Consequently, sheet conveyance problems may occur. For example, the feed roller 41 rotating in the counter-feeding direction may move the lower sheets among the stack of sheets resting on the sheet-feed tray 16 in the counter-feeding direction, creating an inverted wedge-like shape in the stack of sheets such that the upper sheets are positioned further downstream in the feeding direction than the lower sheets. In this case, the upper sheets may be inadvertently conveyed in the feeding direction before the lower sheets. Further, the upper sheets fed from this wedge-like stack may incur damage.

Figure 10:
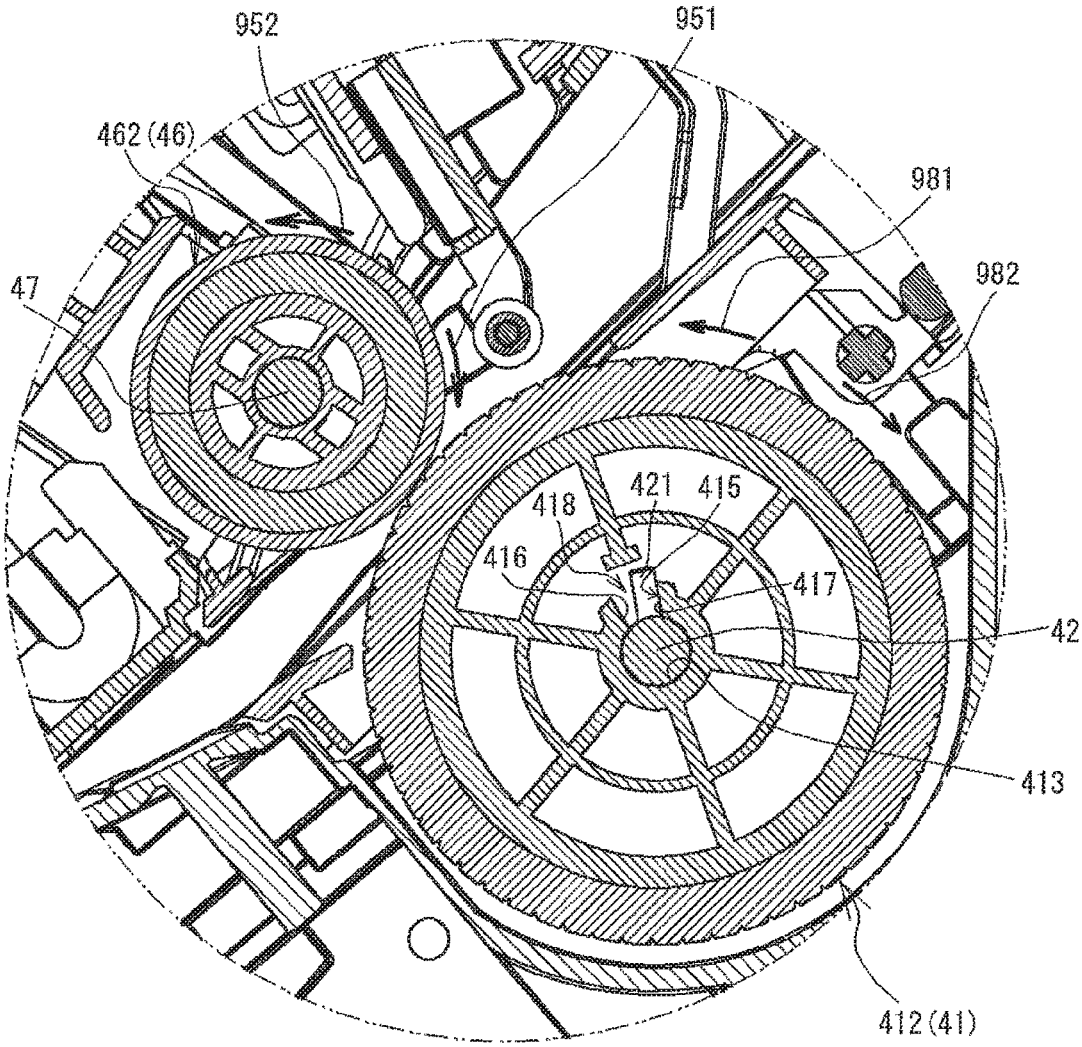
FIG. 10 is a partially-enlarged cross-sectional view illustrating the essential portion of the image-reading device 1 according to the embodiment, and showing a state of the feeding roller 41 and the shaft member 42 when the first operation is not performed as a comparative example to the embodiment.
Figure 10:
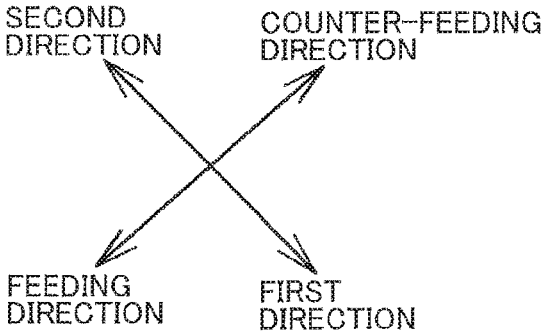

In contrast, in the depicted embodiment, the first operation for rotating the feed roller 41 in the feeding direction is configured to be performed when the reverse roller 46 is rotated in the feeding direction to drive the shutter 81 and pressing member 51. In other words, the drive force is transmitted from the shaft member 42 for rotating the feed roller 41 in the same direction as the reverse roller 46. This configuration can better reduce the likelihood of the gap 418 being produced between the feed roller 41 and shaft member 42 (on the counter-feeding-direction side relative to the feed roller 41), as shown in FIG. 10 than when a drive force is not transmitted from the shaft member 42 to the feed roller 41. Accordingly, when the second operation is executed after the first operation to activate the separating function, there is less potential for the feed roller 41 to rotate in the counter-feeding direction when the reverse roller 46 rotates in the counter-feeding direction. Thus, this method reduces the potential for sheet conveyance problems.

Further, in the depicted embodiment, the feed roller 41 is configured to stop rotating in the feeding direction with the transmission mechanism 71A to halt the first operation (at the timing T3) after the drive shaft 725 of the second motor 72 stops rotating in the forward direction (at the timing T2). This method can more reliably reduce the potential for the gap 418 being generated between the feed roller 41 and shaft member 42 (on the counter-feeding-direction side of the feed roller 41) than if the rotation of the feed roller 41 were to stop before or at the same time that the drive shaft 725 stops rotating in the forward direction. Hence, the method of the embodiment can further reduce the potential for sheet conveyance problems.

Further, during the first operation, the feed roller 41 is configured to be rotated by the transmission mechanism 71A such that the condition of the Equation (1) is met. That is, the feed roller 41 is configured to rotate at a faster speed than the reverse roller 46. This method can more reliably reduce the potential for the gap 418 being generated between the feed roller 41 and shaft member 42 on the counter-feeding-direction side of the feed roller 41 than if the rotational speed of the feed roller 41 were less than or equal to the rotational speed of the reverse roller 46. Thus, the method of the embodiment can further reduce potential for sheet conveyance problems.

Various modifications are conceivable.

For example, the drive force transmitted by the transmission mechanism 71A is not limited to the drive force of the first motor 71, provided that the transmission mechanism 71A can transmit a drive force for rotating the feed roller 41 in the feeding direction. For example, the transmission mechanism 71A may transmit the drive force of the second motor 72 or a drive force of another motor (not shown). Further, one of the shutter 81 and pressing member 51 may be eliminated. Further, a driven member other than the shutter 81 and pressing member 51 may be employed, provided that the driven member can be driven by the drive force transmitted from the second motor 72 whose drive shaft 725 is rotated in the forward direction.

In the first operation of the embodiment described above, the rotational speed of the feed roller 41 must be faster than that of the reverse roller 46 to satisfy the Equation (1). However, the speed of the feed roller 41 may be less than or equal to the speed of the reverse roller 46. Even in this case, there is less potential for the gap 418 to be produced between the feed roller 41 and shaft member 42 on the counter-feeding direction side of the feed roller 41 than if the feed roller 41 were not to perform the first operation.

Further, in the embodiment, the controller 131 is configured to start driving the first motor 71 in order for the feed roller 41 to perform the second operation after the shutter 81 has moved to the non-restricting position. However, the controller 131 may begin driving the first motor 71 to implement the second operation prior to the shutter 81 moving to the non-restricting position.

Further, the rotational speed of the feed roller 41 during the first operation may be the same or different from the rotational speed of the feed roller 41 in the second operation. Note that when the rotational speed of the feed roller 41 during the first operation is the same as the rotational speed of the feed roller 41 during the second operation, the transmission mechanism 71A rotates the feed roller 41 so as to satisfy the condition indicated by Equation (2) below. Here, B denotes a number of rotations per unit time of the shaft member 42 serving as the rotational shaft of the feed roller 41, during the second operation.

$$B=A>C\times r/R \qquad \text{Equation (2)}$$

Further, in the embodiment, after the drive shaft 725 of the second motor 72 stops rotating in the forward direction, the transmission mechanism 71A stops rotating the feed roller 41 in the feeding direction to end the first operation. However, the transmission mechanism 71A may stop rotating the feed roller 41 in the feeding direction to end the first operation before or at the same time the drive shaft 725 stops rotating in the forward direction, for example. With this method as well, there is less potential for the gap 418 to be formed between the feed roller 41 and shaft member 42 on the counter-feeding direction side of the feed roller 41 than when the first operation is not performed.

Further, in the embodiment, the transmission mechanism 71A begins rotating the feed roller 41 in the feeding direction to start the first operation at the same time the drive shaft 725 rotates in the forward direction. However, the transmission mechanism 71A may start rotating the feed roller 41 in the feeding direction to initiate the first operation after the drive shaft 725 begins rotating in the forward direction, provided that the transmission mechanism 71A begins rotating the feed roller 41 in the feeding direction before the drive shaft 725 stops rotating in the forward direction. This method can more reliably reduce the potential for the gap 418 being generated between the feed roller 41 and shaft member 42 on the counter-feeding direction side of the feed roller 41 than if the feed roller 41 were to start rotating in the feeding direction at the same time or after the drive shaft 725 stops rotating in the forward direction. Thus, this method can further reduce the potential for sheet conveyance problems.

Alternatively, the transmission mechanism 71A may begin rotating the feed roller 41 in the feeding direction to initiate the first operation after the drive shaft 725 stops rotating in the forward direction, and may subsequently halt the feed roller 41 to end the first operation.

Further, while the gap 418 shown in FIG. 10 is a gap formed between the wall portion 416 of the opening part 415 and the pin 421 of the shaft member 42, this gap may come in a form of backlash in mechanisms that transmit a drive force to the feed roller 41, such as the one-way clutch or gears. Further, the concept of the gap may be interpreted as "torsion" or "twisting." For example, rather than providing the pin 421 on the shaft member 42, a one-way clutch may be provided between the feed roller 41 and shaft member 42. If the first operation is not performed in this case, torsion or twisting corresponding to the gap 418 may occur between the one-way clutch and the shaft member 42 when the reverse roller 46 rotates in the counter-feeding direction indicated by the arrow 952. However, by executing the first operation while the reverse roller 46 is rotated in the counter-feeding direction indicated by the arrow 952 in the embodiment, the potential for such torsion or twisting can be reduced, thereby reducing the potential for sheet conveyance problems.

While the description has been made in detail with reference to specific embodiments thereof, it would be apparent to those skilled in the art that various changes and modifications may be made therein without departing from the scope of the above described embodiments.

What is claimed is:

1. A sheet feeder comprising:

a feed roller configured to rotate in a feeding direction, the feed roller including a first wall portion and a second wall portion;

a first motor configured to generate a first drive force;

a transmission mechanism configured to transmit the first drive force to the feed roller to rotate the feed roller in the feeding direction, the transmission mechanism including a rotational shaft of the feed roller, the rotational shaft of the feed roller including a contact portion configured to contact the first wall portion and the second wall portion, the first wall portion and the second wall portion being spaced apart from each other to define a gap therebetween in a circumferential direction of the rotational shaft, the contact portion being fixed on a circumferential surface of the rotational shaft and being positioned in the gap between the first wall portion and the second wall portion in the circumferential direction, the contact portion having a dimension smaller than a dimension of the gap in the circumferential direction, the contact portion being configured to contact the first wall portion in accordance with rotation of the rotational shaft to cause the feed roller to rotate in the feeding direction;

a sheet-feed tray;

a sheet sensor configured to detect whether a sheet is placed on the sheet-feed tray;

a second motor including a drive shaft configured to rotate in a forward direction and in a reverse direction opposite the forward direction to generate a second drive force;

a reverse roller configured to contact the feed roller and rotate in the feeding direction and in a counter-feeding direction opposite the feeding direction upon receipt of the second drive force from the second motor, the reverse roller being configured to rotate in the counter-feeding direction in response to rotation of the drive shaft in the reverse direction, the reverse roller being configured to rotate in the feeding direction in response to rotation of the drive shaft in the forward direction; and a driven part configured to be driven upon receipt of the second drive force from the second motor in response to the rotation of the drive shaft in the forward direction, the transmission mechanism being configured to transmit the first drive force to the feed roller to cause the feed roller to perform a first operation for rotating the feed roller in the feeding direction in a case that the reverse roller is rotated in the feeding direction and the driven part is driven in response to the rotation of the drive shaft in the forward direction, the feed roller being configured to perform the first operation after the sheet feeder is powered and before the sheet sensor detects that the sheet is placed on the sheet-feed tray and prior to receipt of an image reading command, and after the feed roller performed the first operation and after the sheet sensor detects that the sheet is placed on the sheet-feed tray and upon receipt of the image reading command, the transmission mechanism being configured to transmit the first drive force to the feed roller to cause the feed roller to perform a second operation for rotating the feed roller in the feeding direction in a case that the reverse roller is rotated in the counter-feeding direction in response to the rotation of the drive shaft in the reverse direction, wherein the transmission mechanism is configured to stop transmitting the first drive force to the feed roller to cause the feed roller to halt rotation in the feeding direction to end the first operation after the drive shaft stops rotating in the forward direction to halt rotation of the reverse roller in the forward direction.

2. The sheet feeder as claimed in claim 1, wherein the reverse roller has a rotational shaft;

wherein, during the first operation, the transmission mechanism is configured to transmit the first drive force to the feed roller to cause the feed roller to rotate in the feeding direction at a prescribed speed, the prescribed speed being determined such that an equation $A>C\times r/R$ is satisfied; and wherein A denotes a number of rotations per unit time of the rotational shaft of the feed roller during the first operation; C denotes a number of rotations per unit time of the rotational shaft of the reverse roller during the first operation; r denotes a radius of the reverse roller; and R denotes a radius of the feed roller.

3. The sheet feeder as claimed in claim 1, wherein the transmission mechanism is configured to start transmitting the first drive force to the feed roller to cause the feed roller to start performing the first operation before the drive shaft stops rotating in the forward direction.

4. The sheet feeder as claimed in claim 1, wherein the transmission mechanism is configured to start transmitting the first drive force to the feed roller to cause the feed roller to start performing the first operation at the same time as the drive shaft starts rotating in the forward direction.

5. The sheet feeder as claimed in claim 1, further comprising a casing defining a sheet conveying path therein, wherein the driven part comprises a shutter configured to move between a first position and a second position upon receipt of the second drive force from the second motor, the shutter being moved to the first position in response to the rotation of the drive shaft in the forward direction and the shutter being moved to the second position in response to the rotation of the drive shaft in the reverse direction, the shutter at the first position having a portion crossing the sheet conveying path and the shutter at the second position being retracted from the sheet conveying path.

6. The sheet feeder as claimed in claim 5, wherein the transmission mechanism is configured to start transmitting the first drive force to the feed roller to cause the feed roller to start performing the second operation after a prescribed period of time has elapsed since the reverse roller starts rotating in the counter-feeding direction in response to the rotation of the drive shaft in the reverse direction after the first operation is ended.

7. The sheet feeder as claimed in claim 6, wherein the prescribed period of time corresponds to a length of time required for the shutter to move from the first position to the second position.

8. The sheet feeder as claimed in claim 1, further comprising a casing defining a sheet conveying path therein, wherein the driven part comprises a pressing member configured to move between a third position and a fourth position upon receipt of the second drive force from the second motor, the pressing member being moved to the third position in response to the rotation of the drive shaft in the reverse direction and the pressing member being moved to the fourth position in response to the rotation of the drive shaft in the forward direction, the pressing member at the third position having a portion interfering with the sheet conveying path and the pressing member at the fourth position retracted from the sheet conveying path.

9. The sheet feeder as claimed in claim 1, wherein the driven part comprises:

a movable member configured to move in a moving direction in response to the rotation of the drive shaft in the forward direction;

a gear provided with a one-way clutch, the one-way clutch being configured to transmit the second drive force of the second motor to the movable member in response to the rotation of the drive shaft in the forward direction but configured to cut off transmission of the second drive force of the second motor to the movable member in response to the rotation of the drive shaft in the reverse direction; and an urging member configured to urge the movable member in a direction opposite the moving direction.

10. The sheet feeder as claimed in claim 1, wherein the driven part comprises a first conveying roller configured to rotate in the feeding direction and in the counter-feeding direction upon receipt of the second drive force from the second motor, the first conveying roller being configured to rotate in the counter-feeding direction in response to the rotation of the drive shaft in the forward direction and the first conveying roller being configured to rotate in the feeding direction in response to the rotation of the drive shaft in the reverse direction.

11. The sheet feeder as claimed in claim 10, further comprising:

an image reader disposed downstream of the first conveying roller in the feeding direction, the image reader being configured to read an image on a sheet; and a second conveying roller disposed downstream of the image reader in the feeding direction, the second conveying roller being configured to rotate in the feeding direction upon receipt of the second drive force from the second motor in response to the rotation of the drive shaft in the reverse direction but configured to be prevented from receiving the second drive force so as not to rotate in the counter-feeding direction in response to the rotation of the drive shaft in the forward direction.

* * * * *